US008068071B2

(12) United States Patent
Abe et al.

(10) Patent No.: US 8,068,071 B2
(45) Date of Patent: Nov. 29, 2011

(54) PIXEL CIRCUIT AND IMAGE DISPLAY APPARATUS HAVING THE PIXEL CIRCUIT

(75) Inventors: Katsumi Abe, Kawasaki (JP); Hideya Kumomi, Tokyo (JP); Ryo Hayashi, Yokohama (JP); Masafumi Sano, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 760 days.

(21) Appl. No.: 11/683,872

(22) Filed: Mar. 8, 2007

(65) Prior Publication Data

US 2009/0102829 A1 Apr. 23, 2009

(30) Foreign Application Priority Data

Mar. 13, 2006 (JP) ..... 2006-067527

(51) Int. Cl.
*G09G 3/30* (2006.01)
*G09G 3/32* (2006.01)

(52) U.S. Cl. ..... 345/76; 345/82; 315/169.3

(58) Field of Classification Search ..... 345/73–83, 345/204–211; 315/169.1–169.4
See application file for complete search history.

(56) References Cited

U.S. PATENT DOCUMENTS

| | | | | |
|---|---|---|---|---|
| 4,893,154 | A | 1/1990 | Hirai et al. | 357/4 |
| 5,889,696 | A * | 3/1999 | Kawakubo et al. | 365/145 |
| 6,611,557 | B1 | 8/2003 | Kobayashi | 375/225 |
| 2002/0195964 | A1 | 12/2002 | Yumoto | 315/169.3 |
| 2003/0142533 | A1* | 7/2003 | Ueda et al. | 365/145 |
| 2006/0038758 | A1* | 2/2006 | Routley et al. | 345/81 |
| 2006/0119548 | A1* | 6/2006 | Lan et al. | 345/76 |
| 2006/0181486 | A1* | 8/2006 | Tseng et al. | 345/55 |
| 2006/0226788 | A1* | 10/2006 | Ogawa | 315/169.3 |
| 2006/0232217 | A1* | 10/2006 | Oh et al. | 315/169.3 |

(Continued)

FOREIGN PATENT DOCUMENTS

JP 2000-22776 1/2000

(Continued)

OTHER PUBLICATIONS

J-H. Lee et al., "P-2: A New a-Si:H TFT Pixel Circuit Suppressing OLED Current Error Caused by the Hysteresis and Threshold Voltage Shift for Active Matrix Organic Light Emitting Diode", 2005 SID International Symposium, Boston, MA, USA, May 24-27, 2005, pp. 228-231.

(Continued)

*Primary Examiner* — Alexander Eisen
*Assistant Examiner* — Patrick F Marinelli
(74) *Attorney, Agent, or Firm* — Fitzpatrick, Cella, Harper & Scinto

(57) ABSTRACT

A pixel circuit and an image display apparatus are provided making use of a hysteresis characteristics of a transistor for driving a display element. The pixel circuit comprises: a transistor providing both different first and second relations between a gate voltage value and a drain current value at a transition from off state to an on state, and from the on state transits to the off state respectively; a display element supplied as a drive current with a current controlled by the transistor; and a capacitor element connected to a gate electrode of the transistor. One of the first and second relations is utilized during a first period for setting the drive current to be supplied to the display element. And, the other of the first and second relations is utilized during a second period for supplying the drive current to the display element to effect light emission.

4 Claims, 16 Drawing Sheets

U.S. PATENT DOCUMENTS

2008/0143648 A1 * 6/2008 Ishizuka et al. ..... 345/76

FOREIGN PATENT DOCUMENTS

| | | | |
|---|---|---|---|
| JP | 2002-76356 | | 3/2002 |
| WO | WO 99/65011 | | 12/1999 |
| WO | WO 01/06484 | A1 | 1/2001 |
| WO | WO 2005/088726 | A1 | 9/2005 |
| WO | WO 2005106834 | A1 * | 11/2005 |

OTHER PUBLICATIONS

S. Ono et al., "An Accelerative Current-Programming Method for AM-OLED", IEICE Trans. Electron., vol. E88-C, No. 2, pp. 264-269 (2005).

European Communication and Search Report, regarding Application No. 07005068.7-2205/1835486.

* cited by examiner

PIXEL CIRCUIT AND IMAGE DISPLAY APPARATUS HAVING THE PIXEL CIRCUIT

BACKGROUND OF THE INVENTION

1. Field of the Invention

The present invention relates to a drive circuit for driving a display element such as an organic light-emitting diode (hereinafter denoted by OLED) element and the like, and an image display apparatus using the drive circuit.

2. Description of the Related Art

An active matrix (hereinafter denoted by AM) type OLED display has been studied recently as a light emission display device having pixels arranged in a matrix shape, each pixel being constituted of an OLED element and a drive circuit.

Figure 1:
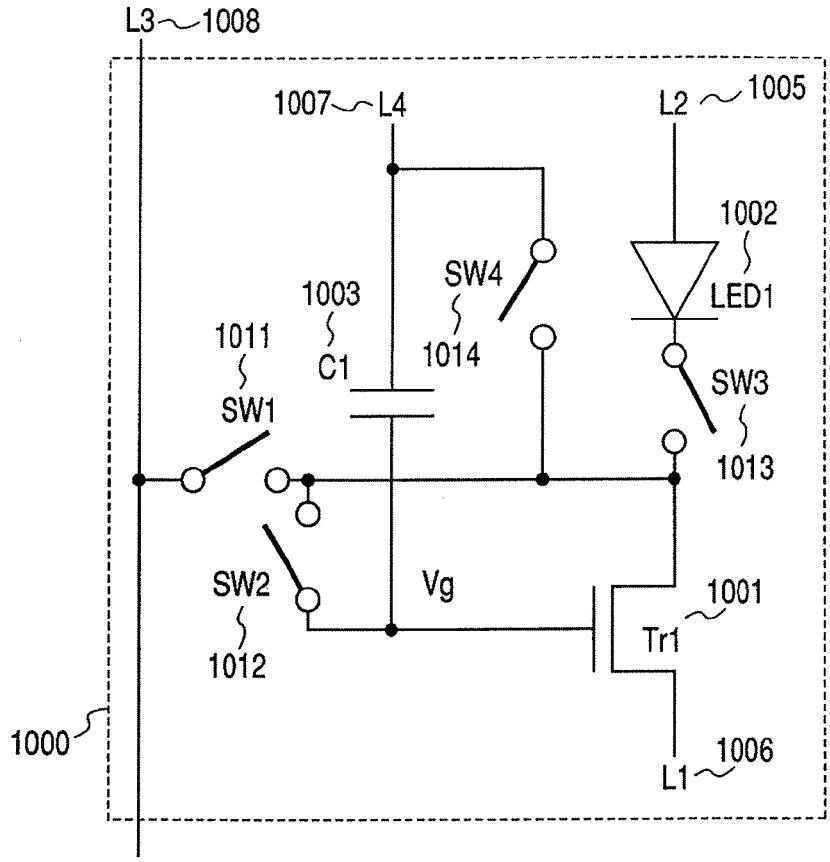

SW1 and SW2 are turned on, and current is supplied from an external (L3) to a TFT (Tr1) in the pixel circuit whose gate and drain are shorted.

A gate voltage value Vg1 of TFT can therefore be set to a voltage at which the external current flows as a drain current.

Current flowing a light emission element can thus be set.

Thereafter, in the state that the gate voltage value Vg1 is retained, SW1 and SW2 are turned off and SW3 is turned on to switch a current path to the OLED element (LED1) side.

Since a voltage between the gate and source of TFT is the same voltage at which the current from the external L3 flows, TFT (Tr1) functions as a current source for supplying a constant current having the same amplitude as that of the external current. Namely, current having the same amplitude as that of the current from the external (L3) flows through the OLED element.

A display element operating by the current drive described above is described in International Publication No. WO99/065011.

SUMMARY OF THE INVENTION

The development of TFT is in progress in which semiconductor such as polycrystal-Si (hereinafter denoted by p-Si), amorphous silicon (hereinafter denoted by a-Si) and organic semiconductor (hereinafter denoted by OS) is used as the material constituting a channel layer of the transistor.

According to the knowledge of the present inventors, TFT using a-Si, OS or oxide semiconductor in the channel layer shows in some case the hysteresis characteristics in the relation between gate voltage and drain current.

The hysteresis characteristics mean that there are different drain currents even at the same gate voltage value in the following first and second cases.

First case: The gate voltage is continuously changed from a voltage value (off state) in a small drain current state (or a state in which drain current will not flow substantially) to a voltage value (on state) in the state that larger drain current flows.

Second case: The gate voltage is continuously changed from the on state to the off state, opposite to the first case.

The present inventors have made the following inventions under the object of providing a pixel circuit considering that a transistor has the hysteresis characteristics.

In the following, current supplied to the display element is expressed as drive current.

A pixel circuit according to the first invention comprises: a transistor providing both first and second relations, the first relation being a relation between a gate voltage value and a drain current value when an off state transits to an on state, the second relation being different from the first relation and being a relation between the gate voltage value and the drain current value when the on state transits to the off state; a display element being supplied as a drive current with a current controlled by the transistor; and a capacitor element connected to a gate electrode of the transistor, wherein: the transistor is acting on one of the first and second relations during a first period for setting the drive current to be supplied to the display element; and the transistor is acting on the other of the first and second relations during a second period for supplying the drive current to the display element to effect light emission.

In the first invention, the gate voltage value of the transistor for flowing the drive current can be set between the on state and off state.

A pixel circuit according to the second invention comprises: a transistor providing both first and second relations, the first relation being a relation between a gate voltage value and a drain current value when an off state transits to an on state, the second relation being different from the first relation and being a relation between the gate voltage value and the drain current value when the on state transits to the off state; a display element being supplied as a drive current with a current controlled by the transistor; and a capacitor element connected to a gate electrode of the transistor, wherein: there are provided a first period for setting the drive current to be supplied to the display element and a second period for supplying the drive current to the display element to effect light emission; and in order to be the transistor acting on only one of the first and second relations during both the first and second periods; (1) the drive current is set, and thereafter after the transistor is set to the off state, the drive current is supplied to the display element, or (2) the drive current is set, and thereafter after the transistor is set to the on state, the drive current is supplied to the display element.

In an image display apparatus according to the third invention: one pixel is constituted of any one of the pixel circuits described above, a plurality of the pixels are arranged in a matrix shape; data lines and scan lines are provided being connected to the pixel circuits.

In a drive method according to another invention for a display element having a transistor for driving the display element, a first period for setting a current to be supplied to the display element and a second period for supplying a drive current to the display element, the transistor has clockwise hysteresis characteristics in which even at the same gate voltage value, the drain current value set from the on state is smaller than the drain current value set from the off state, after the transistor is set to the off state, the gate voltage value of the transistor is set so as to make a drain current have a first current value during the first period, and by reversing the gate voltage value of the transistor after the gate voltage value is set once to the on-state, a second current value smaller than the first current value is supplied to the display element as the drive current during the second period.

In a drive method according to another invention for a display element having a transistor for driving the display element, a first period for setting a current to be supplied to the display element and a second period for supplying a drive current to the display element, the transistor has counter-clockwise hysteresis characteristics in which even at the same gate voltage value, the drain current value set from the on state is larger than the drain current value set from the off state, after the transistor is set to the on state, the gate voltage value of the transistor is set so as to make a drain current have a third current value during the first period, and by reversing the gate voltage value of the transistor after the gate voltage value is set once to the off state, a fourth current value smaller than the third current value is supplied to the display element as the drive current during the second period.

In a drive method according to another invention for a display element having a transistor for driving the display element, a first period for setting a current to be supplied to the display element and a second period for supplying a drive current to the display element, the transistor is set to an on state or an off state before the first period and before the second period.

Further features of the present invention will become apparent from the following description of exemplary embodiments with reference to the attached drawings.

DESCRIPTION OF THE EMBODIMENTS

FIG. 1 shows an example of a circuit diagram for explaining the present invention.

Figure 2:
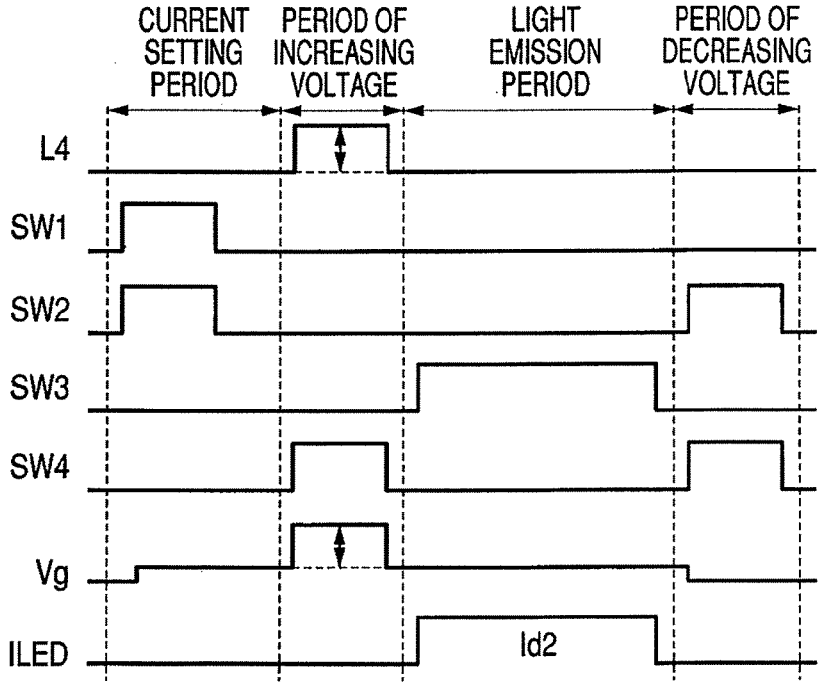

FIG. 2 is a timing chart showing an operation example of a pixel circuit of the present invention.

Figure 3:
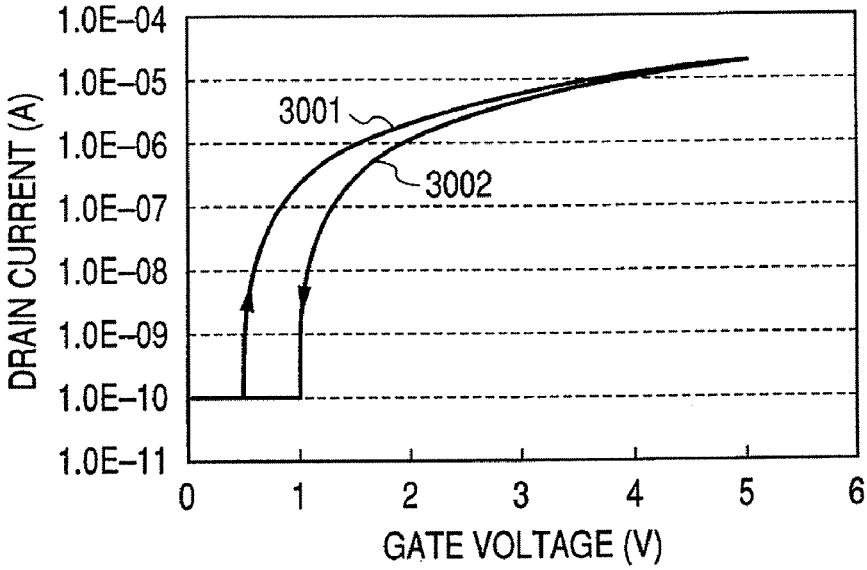

FIG. 3 is a diagram showing the voltage-current characteristics of a transistor having clockwise hysteresis.

Figure 4:
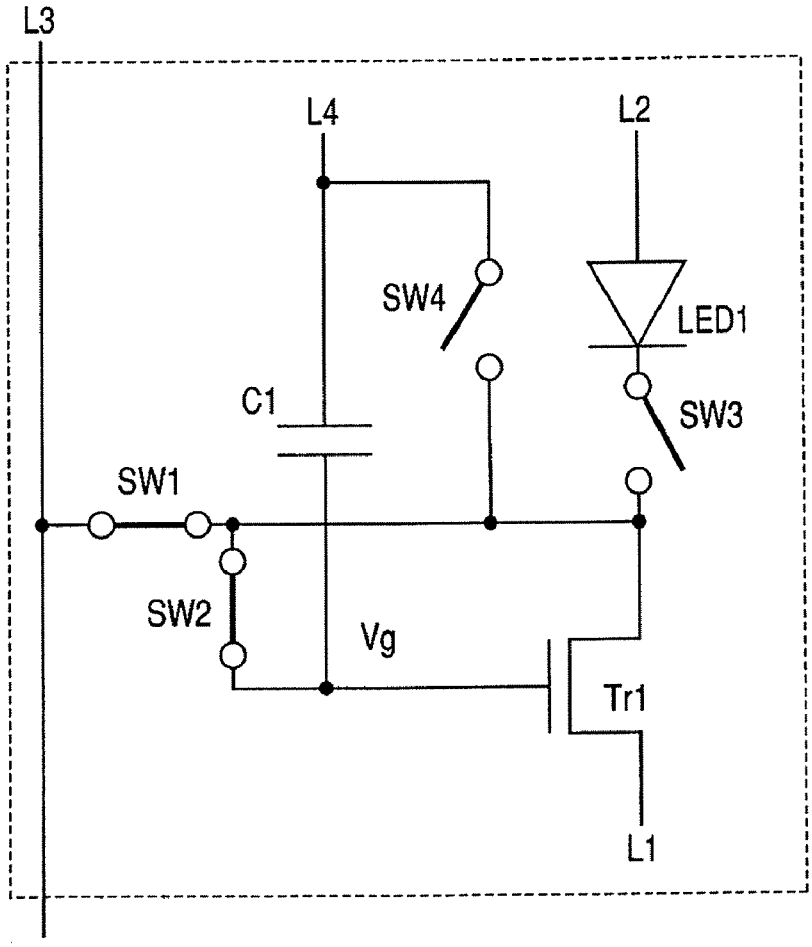

FIG. 4 is a diagram showing the states of switches during a current setting period according to a first embodiment.

Figure 5:
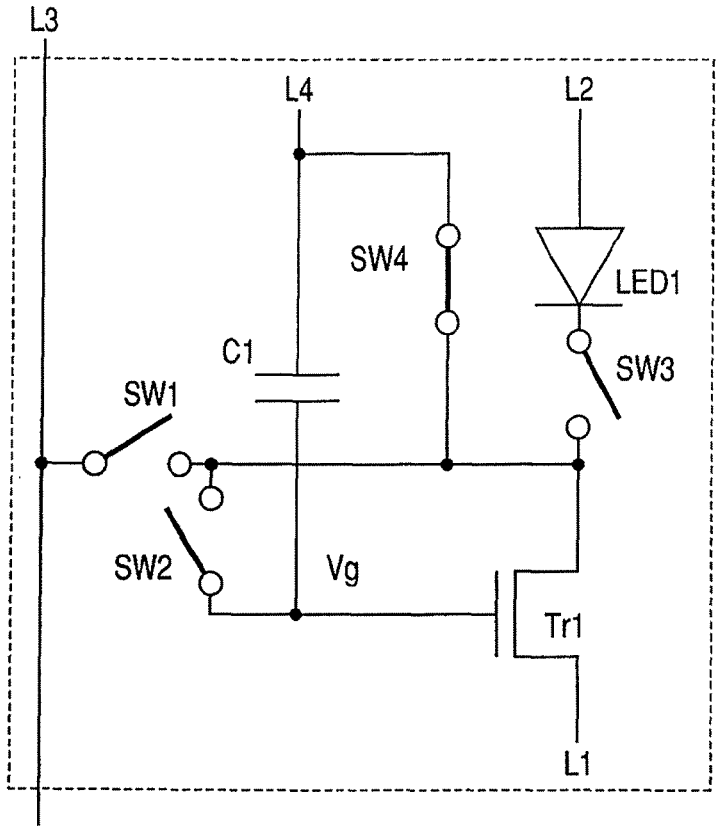

FIG. 5 is a diagram showing the states of switches during a period of increasing voltage according to the first embodiment.

Figure 6:
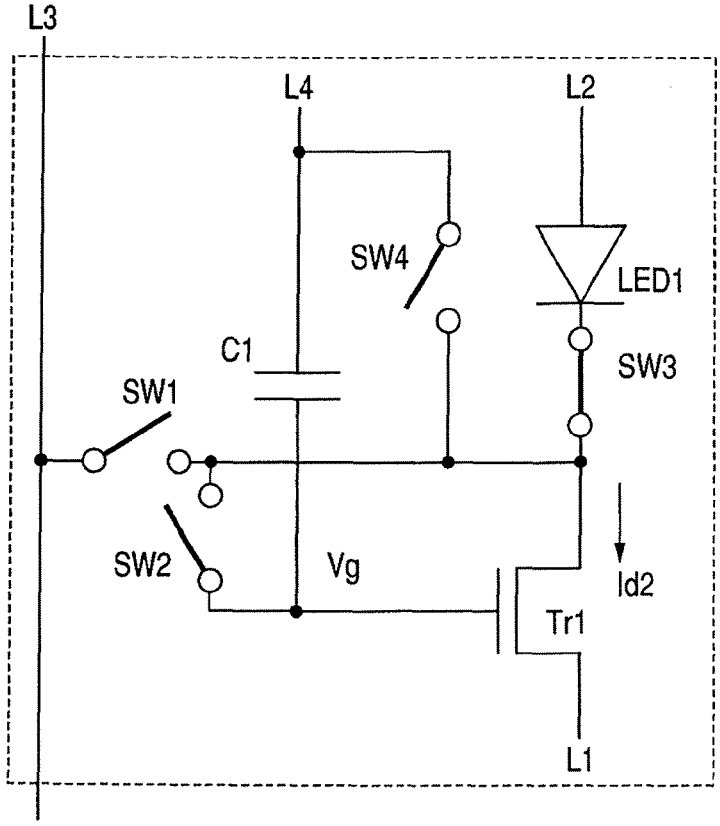

FIG. 6 is a diagram showing the states of switches during a light emission period according to the first embodiment.

Figure 7:
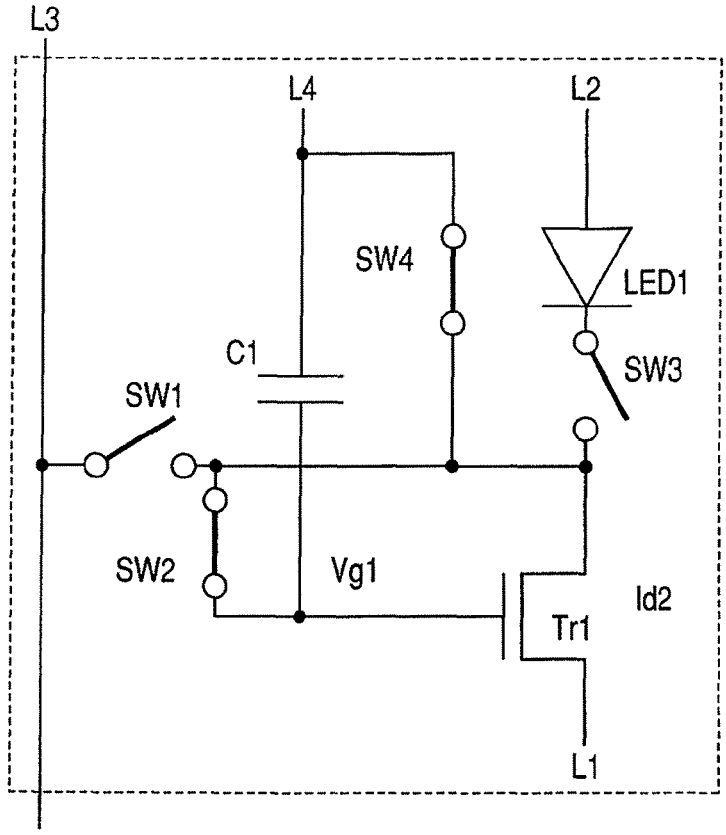

FIG. 7 is a diagram showing the states of switches during a period of decreasing voltage according to the first embodiment.

Figure 8:
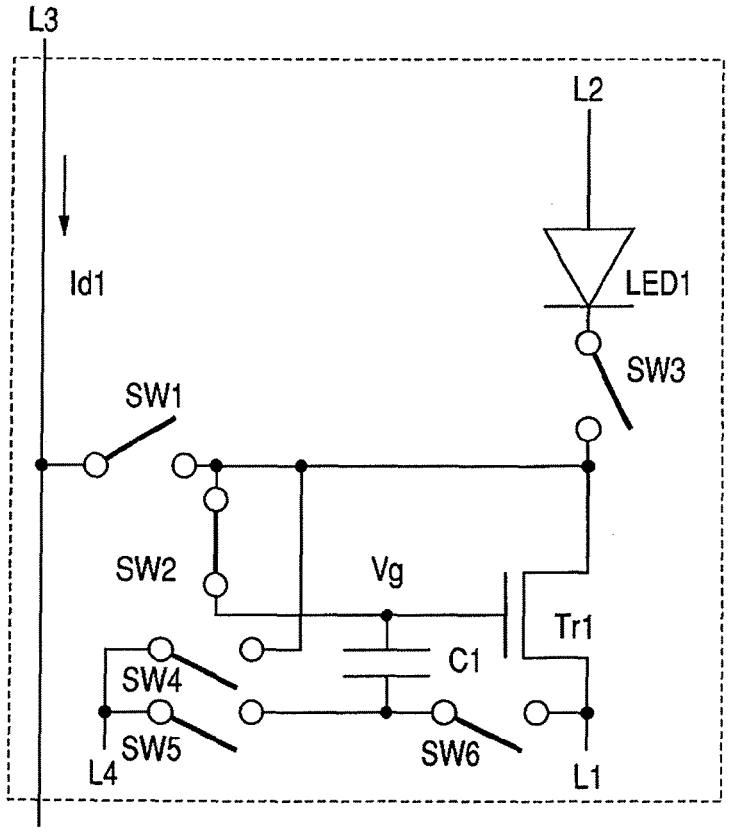

FIG. 8 is a circuit diagram according to a second embodiment.

Figure 9:
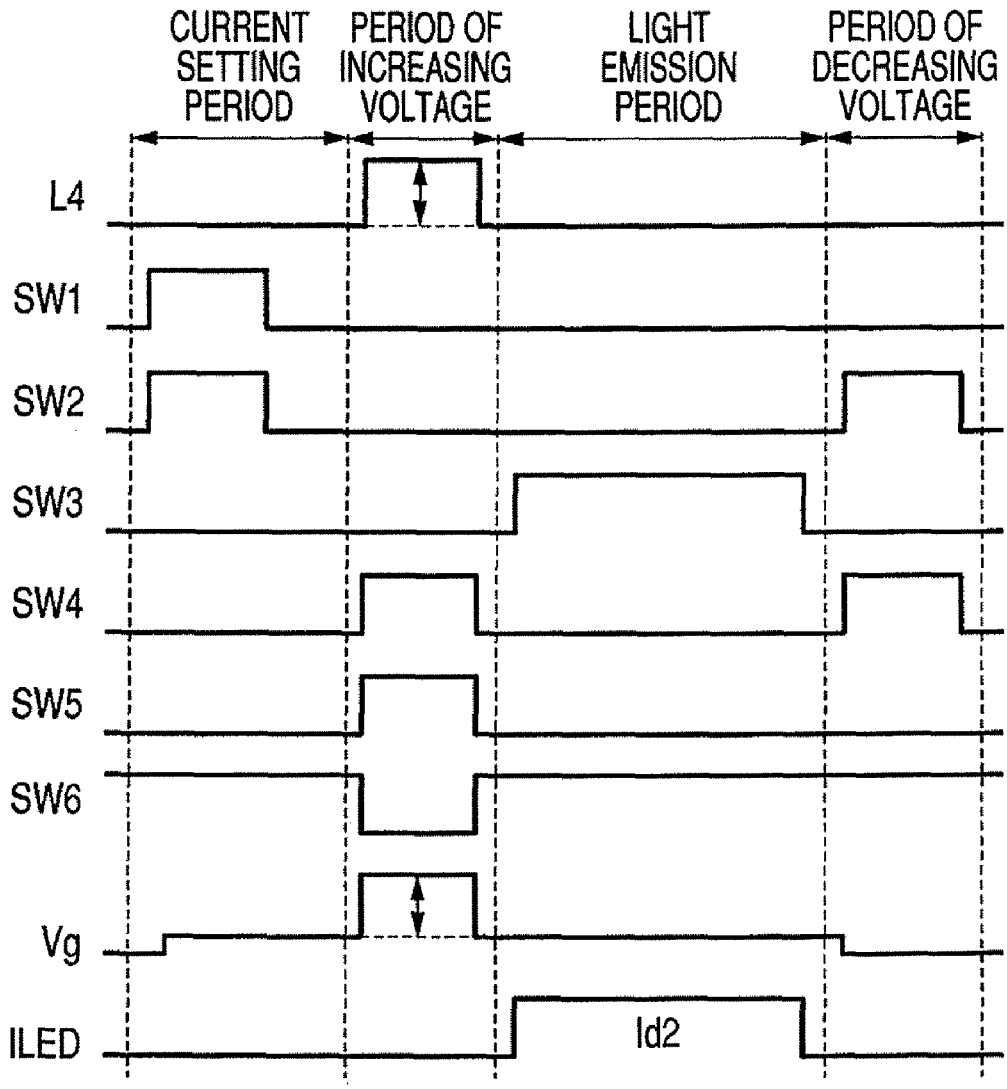

FIG. 9 is a timing chart showing the operation of the circuit of the second embodiment.

Figure 10:
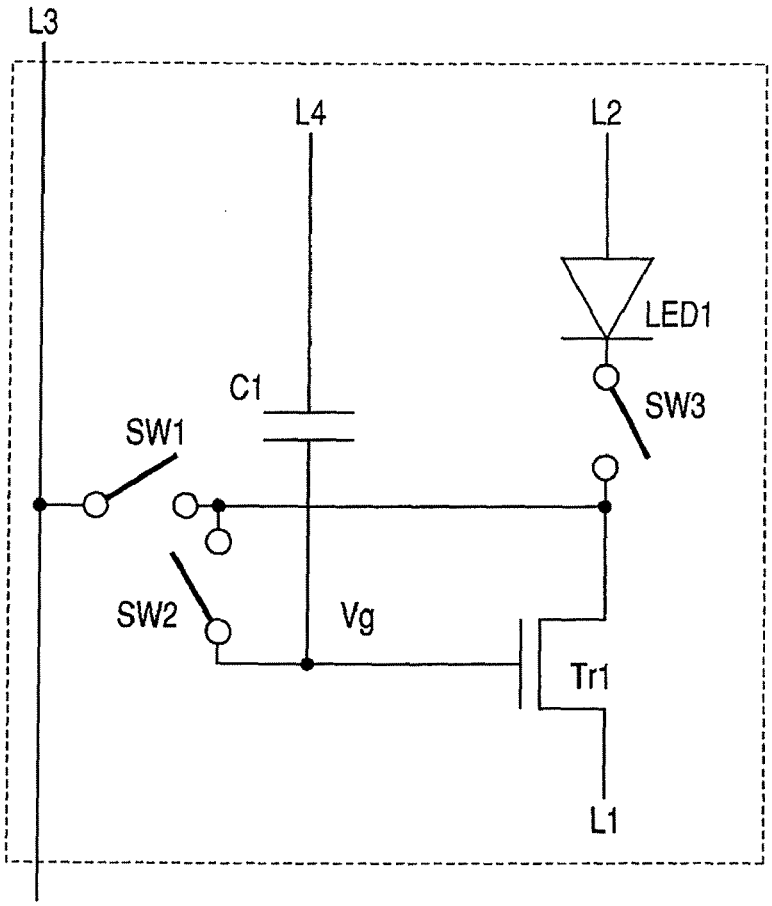

FIG. 10 is a circuit diagram according to a third embodiment.

Figure 11:
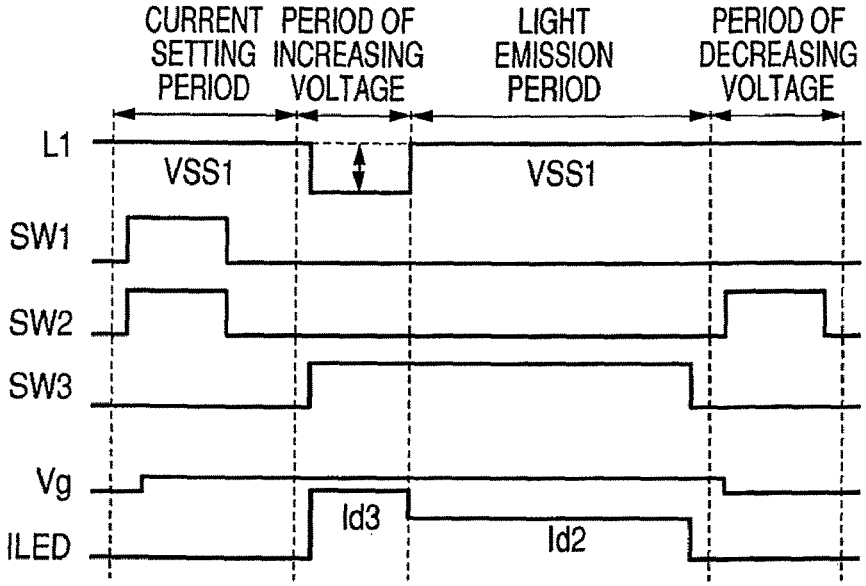

FIG. 11 is a timing chart showing the operation of the circuit of the third embodiment.

Figure 12:
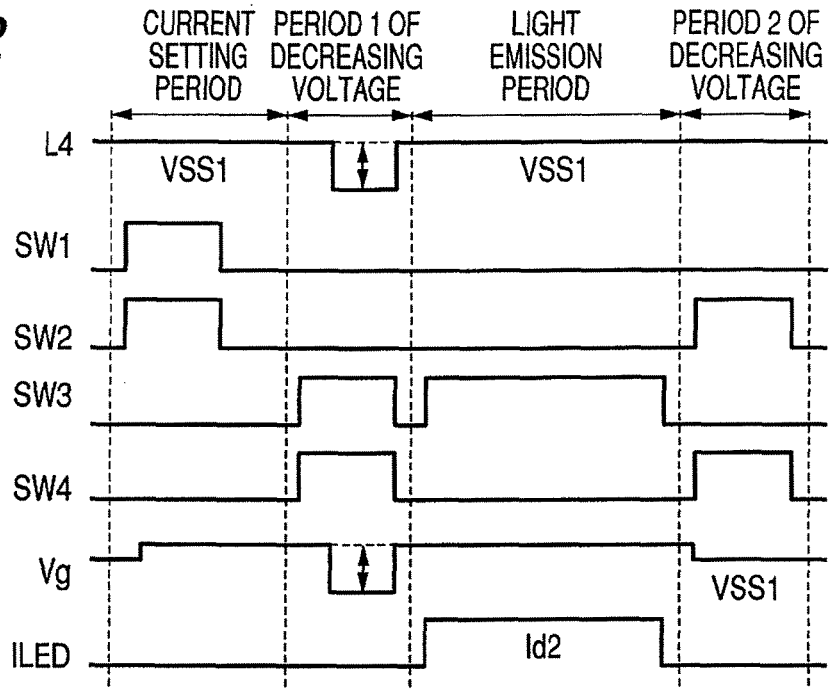

FIG. 12 is a timing chart showing the operation of a circuit according to a fourth embodiment.

Figure 13:
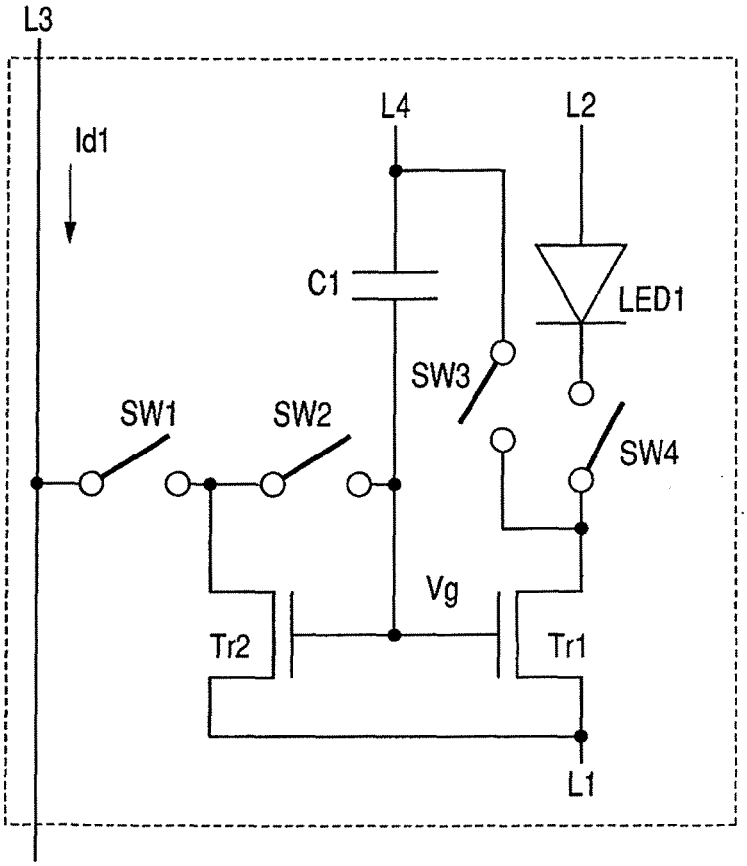

FIG. 13 is a circuit diagram according to a fifth embodiment.

Figure 14:
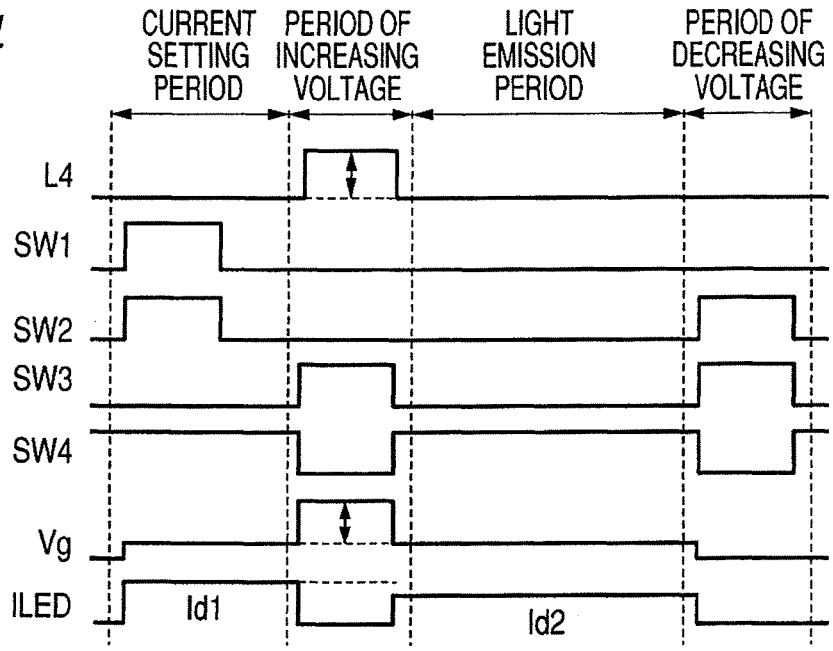

FIG. 14 is a timing chart showing the operation of the circuit of the fifth embodiment.

Figure 15:
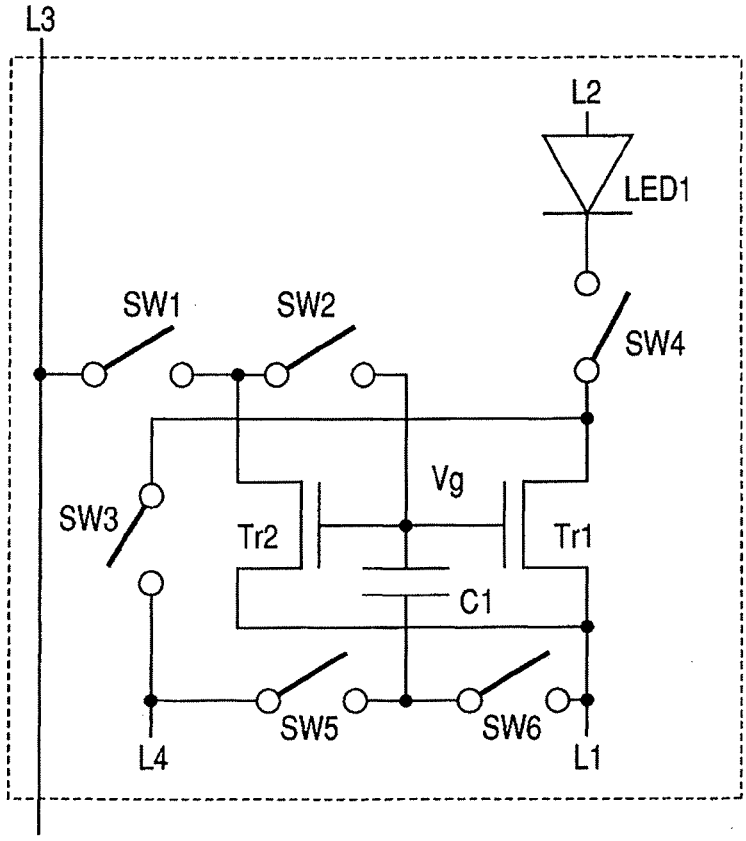

FIG. 15 is a circuit diagram according to a sixth embodiment.

Figure 16:
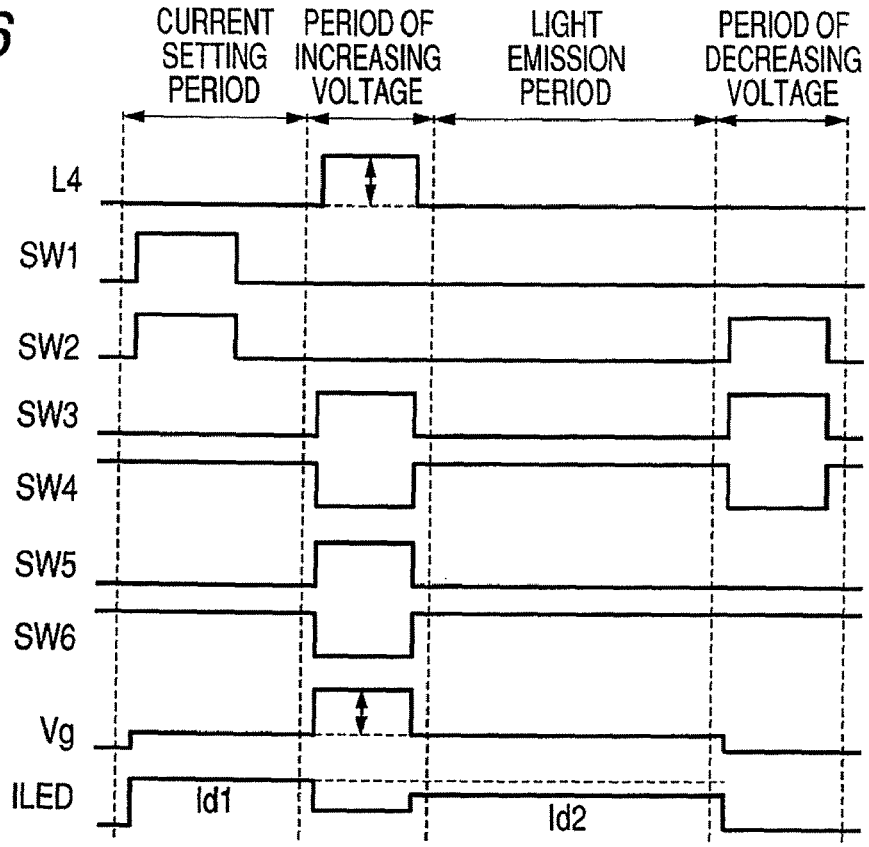

FIG. 16 is a timing chart showing the operation of the circuit of the sixth embodiment.

Figure 17:
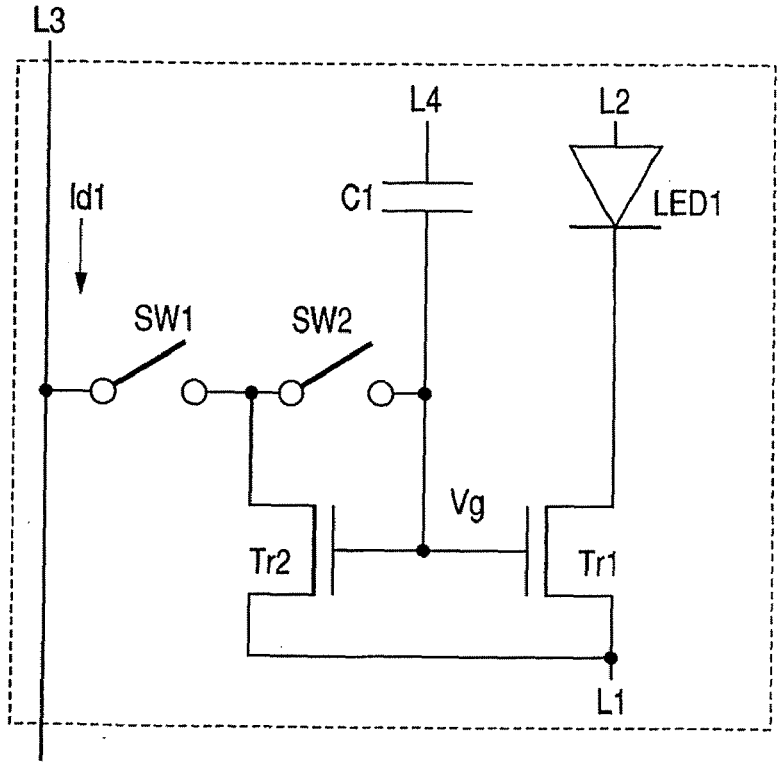

FIG. 17 is a circuit diagram according to a seventh embodiment.

Figure 18:
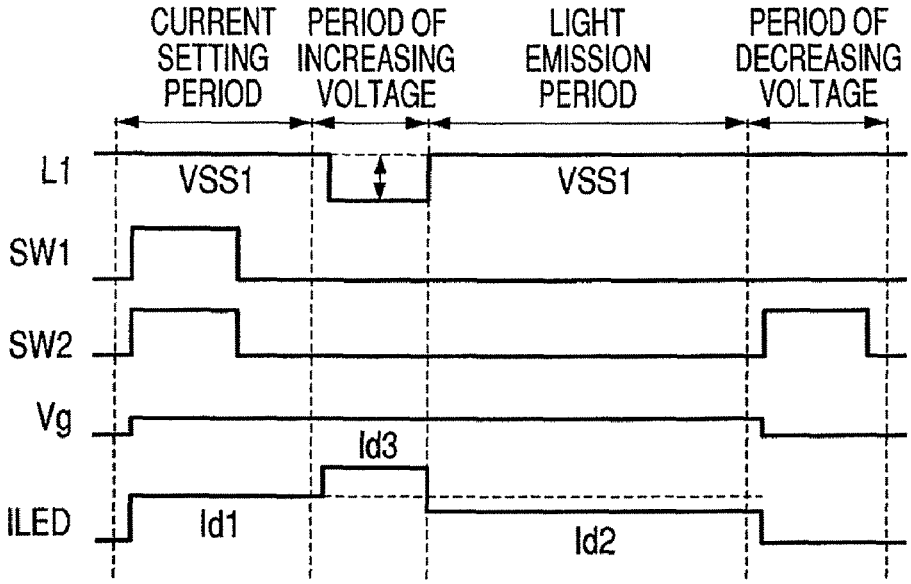

FIG. 18 is a timing chart showing the operation of the circuit of the seventh embodiment.

Figure 19:
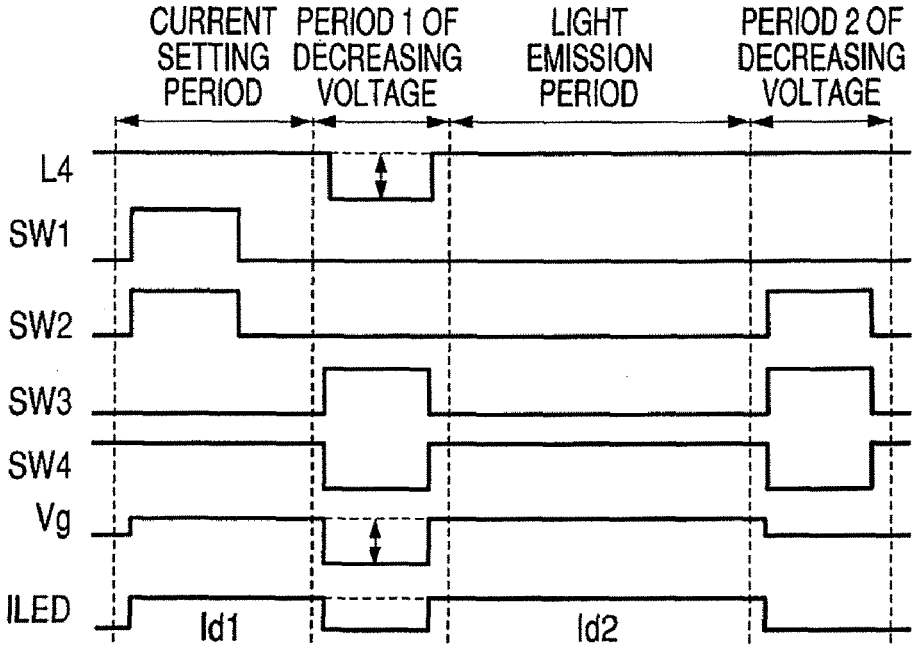

FIG. 19 is a timing chart showing the operation of a circuit according to an eighth embodiment.

Figure 20:
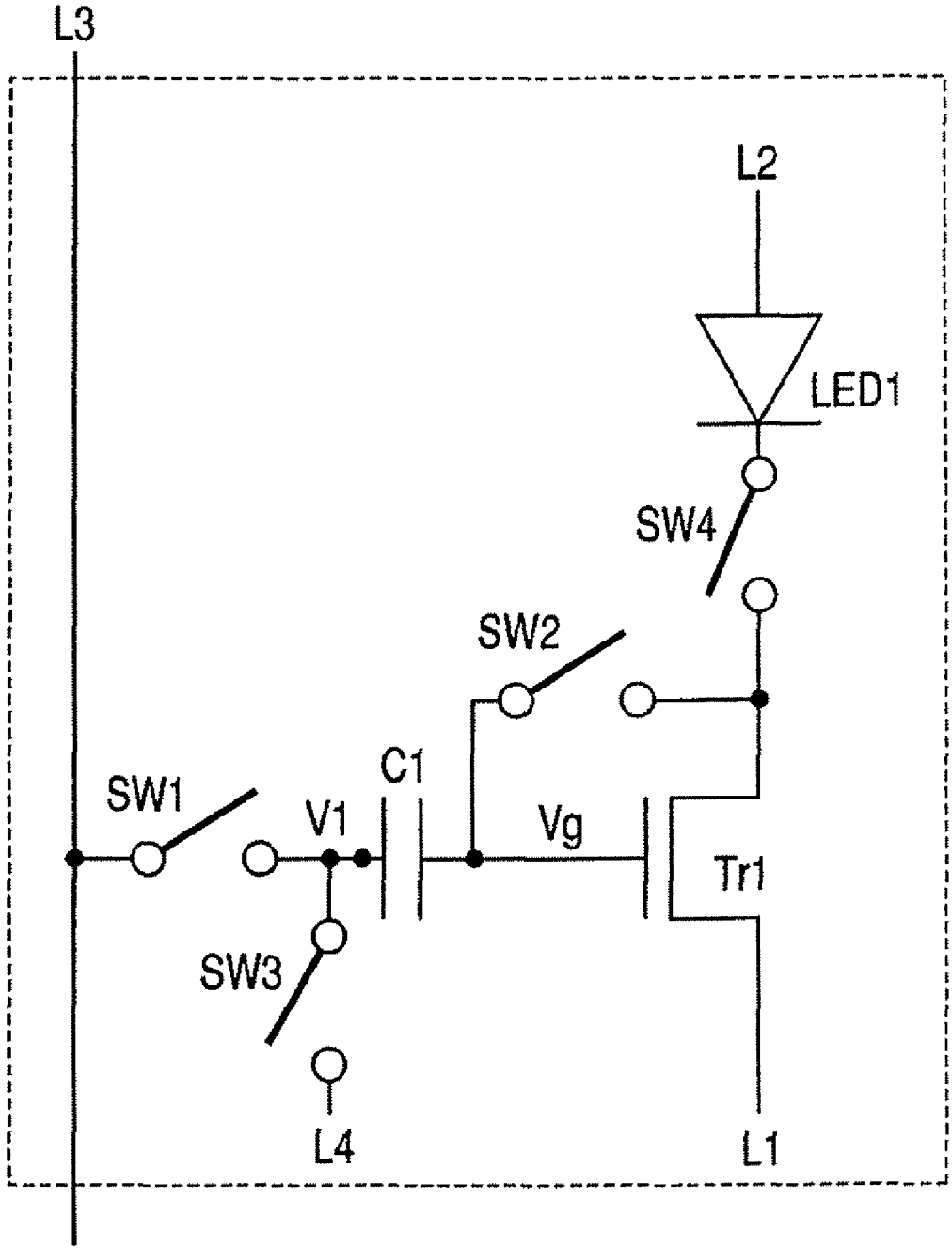

FIG. 20 is a circuit diagram explaining the techniques on the basis of which ninth and tenth embodiments are realized.

Figure 21:
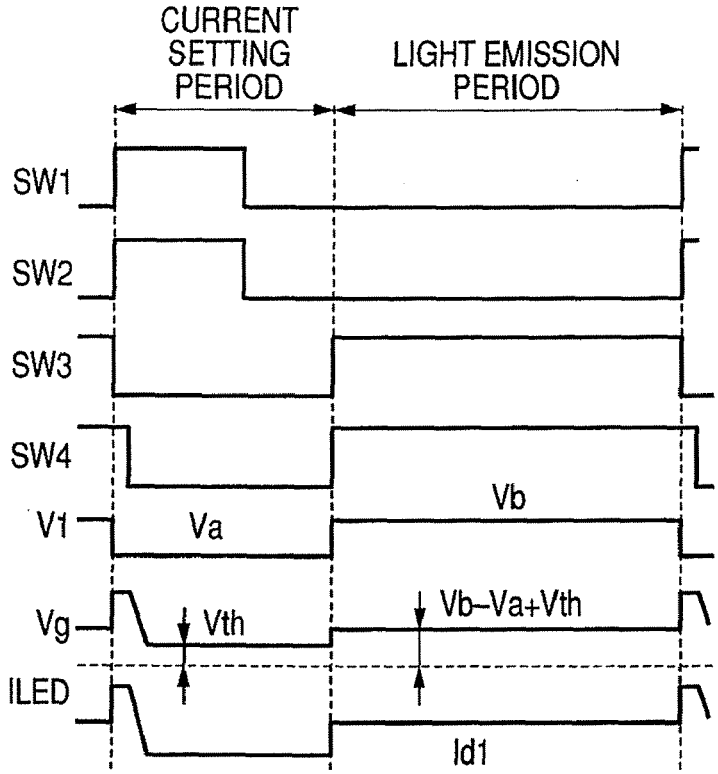

FIG. 21 is a timing chart showing the operation of the circuit shown in FIG. 20.

Figure 22:
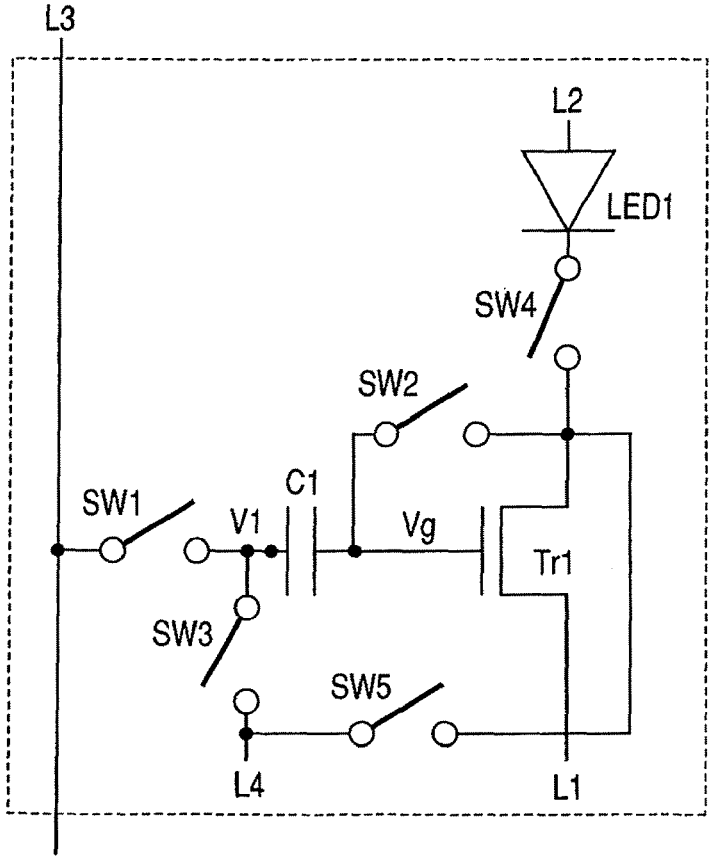

FIG. 22 is a circuit diagram according to the ninth embodiment.

Figure 23:
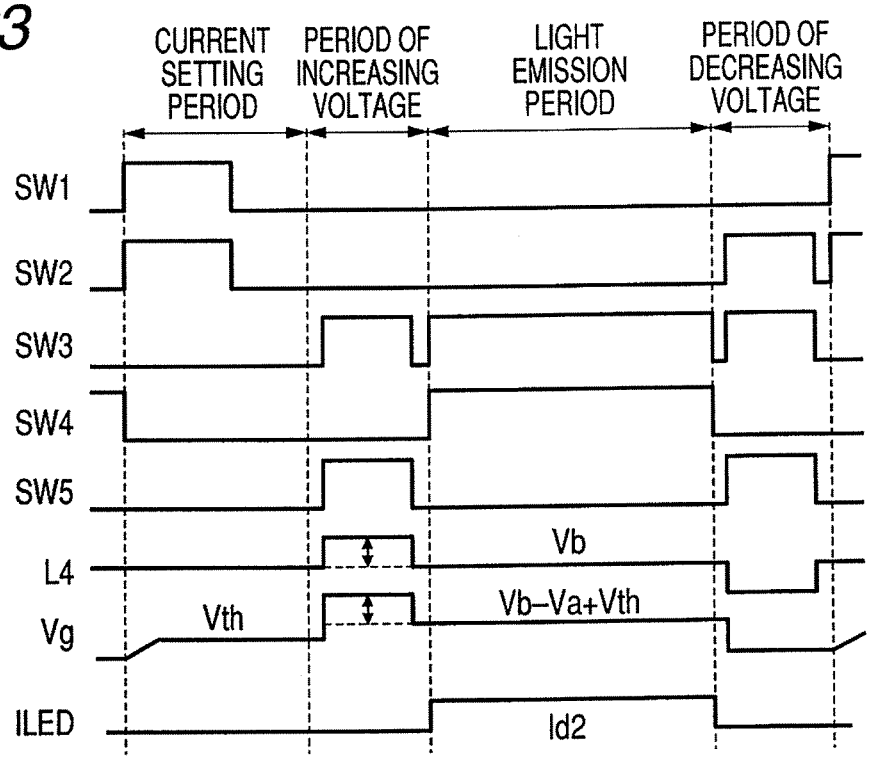

FIG. 23 is a timing chart showing the operation of the circuit diagram described in the ninth embodiment.

Figure 24:
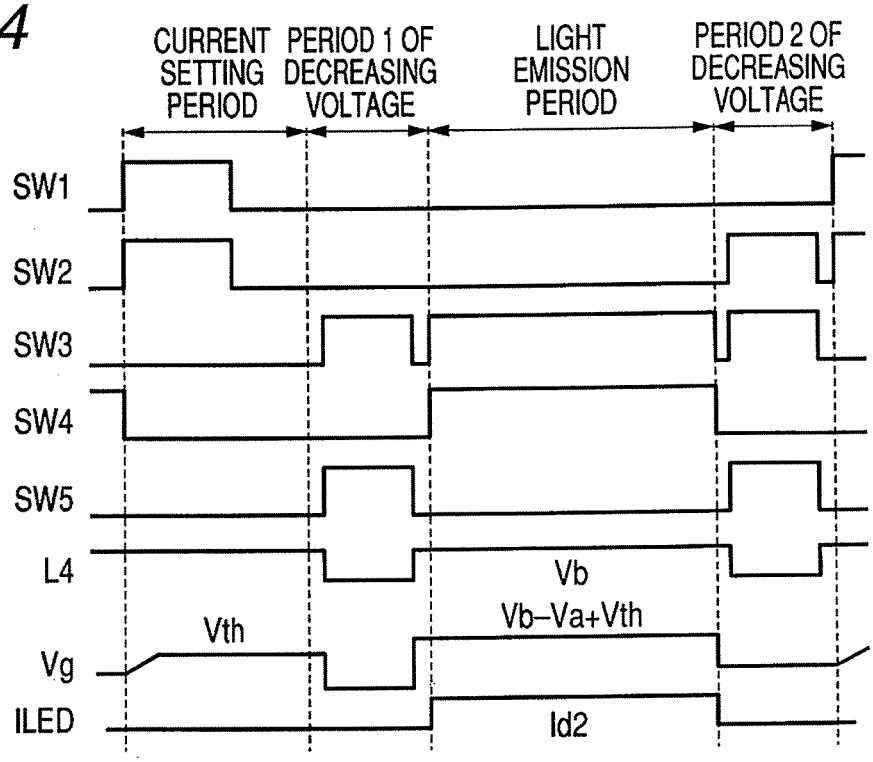

FIG. 24 is a timing chart showing the operation of the circuit diagram described in the ninth embodiment.

Figure 25:
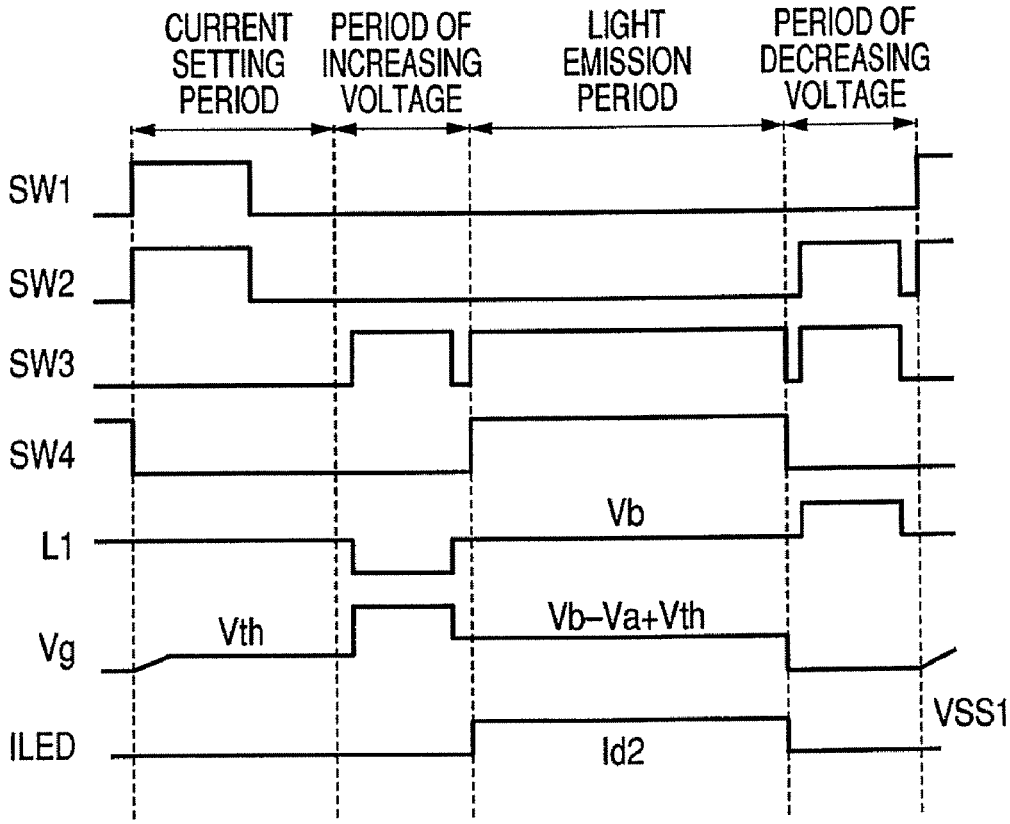

FIG. 25 is a timing chart showing the operation of the circuit described in the tenth embodiment.

Figure 26:
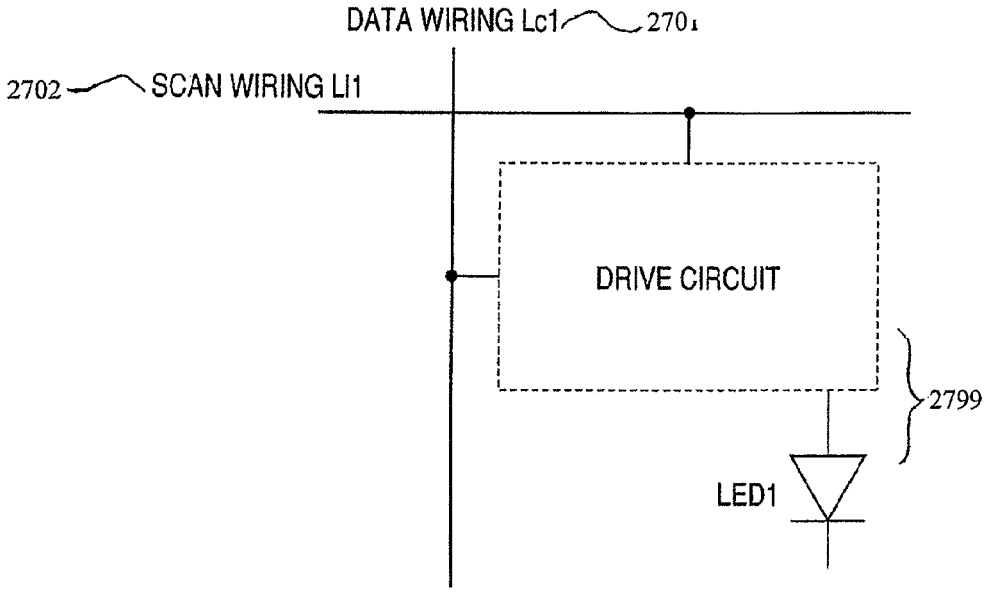
FIG. 26 (PRIOR ART)
FIG. 26 shows an outline structure of a pixel circuit constituted of an OLED element and a drive circuit.

FIG. 26 is a diagram showing an example of the structure of a pixel of a light emission display device.

Figure 27:
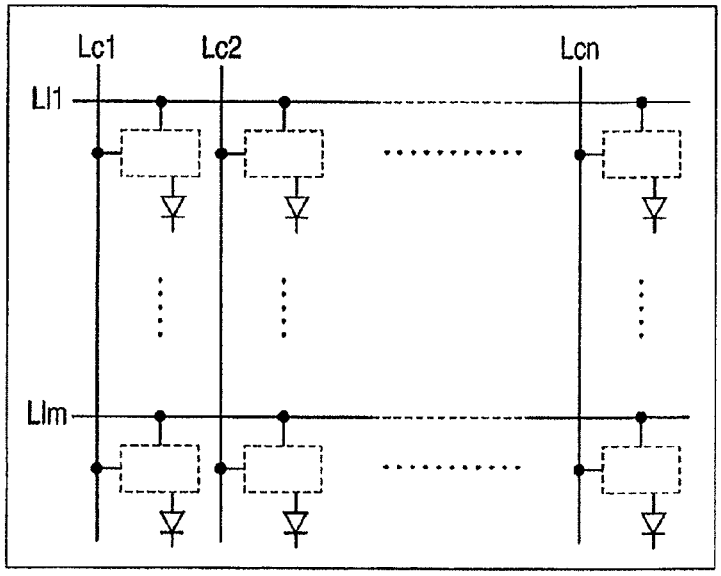
FIG. 27 (PRIOR ART)
FIG. 27 shows an AM type organic display having the pixel circuits arranged in a matrix shape.

FIG. 27 is a diagram showing an example of the structure of an OLED display apparatus.

Figure 28:
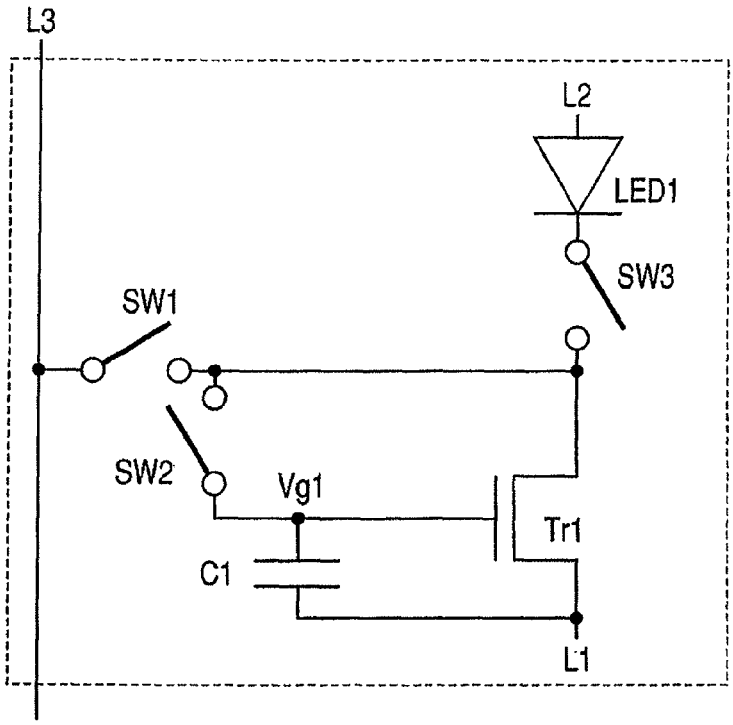
FIG. 28 (PRIOR ART)
FIG. 28 shows an example of the pixel circuit.

FIG. 28 shows an example of the circuit diagram according to conventional techniques.

Figure 29:
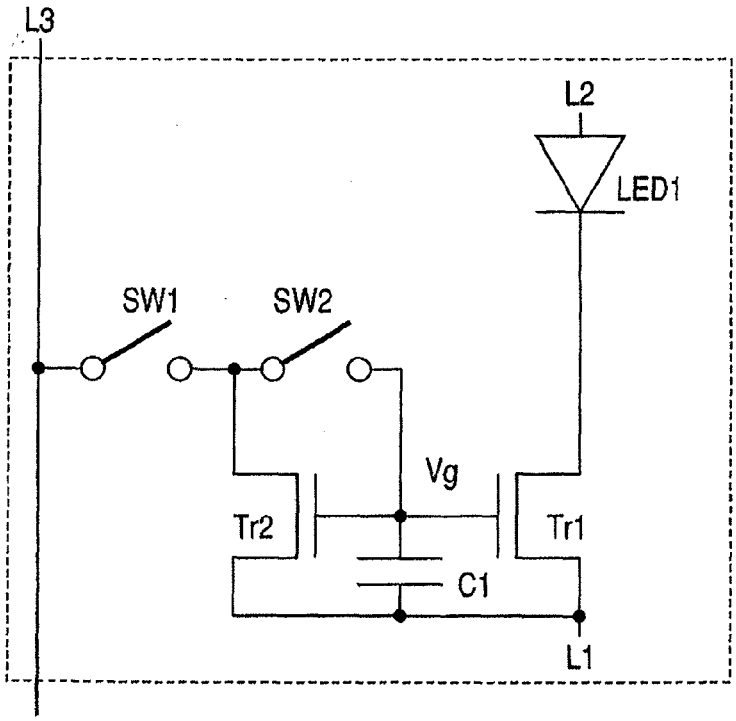
FIG. 29 (PRIOR ART)

FIG. 29 shows an example of a circuit diagram.

DESCRIPTION OF THE EMBODIMENTS

First Embodiment Type

Pixel Circuit Positively Utilizing Both First and Second Relations of Hysteresis Description will be made on the invention regarding the first embodiment type.

First, a transistor is prepared which has the hysteresis characteristics in the relation between gate voltage and drain current.

Specifically, for example as shown in FIG. 3, a transistor is prepared which has a first relation 3001 between a gate voltage value and a drain current value while an off state is changed to an on state and a second relation 3002 between a gate voltage value and a drain current value while an on state is changed to an off state.

The invention regarding this embodiment type is applicable to the transistor having the hysteresis characteristics regardless of whether the characteristics are large or small.

For example, the invention is applicable to a transistor having the characteristics that a gate voltage value at which the drain current is 1 nA has a difference of 0.05 V or higher or 0.5 V or higher between the first and second relations. Although the upper limit of the gate voltage difference is not limited, it may be 5 V for example.

With reference to FIG. 1, description will be made on an example of a pixel circuit applied to the invention regarding this embodiment type. It is obvious that the pixel circuit applied to the invention regarding this embodiment type is not limited to the pixel circuit shown in FIG. 1.

The prepared transistor corresponds to a transistor Tr1 (1001) shown in FIG. 1.

A display element LED1 (1002) is prepared, a switching operation of its supply current being conducted by the transistor.

A capacitor element C1 (1003) is connected to the gate electrode of the transistor 1001.

One of the first and second relations (3001 and 3002 in FIG. 3) is utilized during a first period while a drive current to be supplied to the display element 1002 is set.

Further, the other relation is utilized during a second period while light emission is effected by supplying the drive current to the display element 1002.

The first relation 3001 can be used during the first period, and the second relation 3002 can be used during the second period. The second relation may be used during the first period, and the first relation may be used during the second period.

A current value set during the first period is stored and retained in the capacitor element 1003 connected to the gate electrode. Before the start of the second period, i.e., a light emission period, the gate voltage value is increased once and then decreased or other operations are performed so that the relation between the gate voltage and drain current can be transited from the first relation to second relation (or from the second relation to first relation).

It is therefore possible to make the drain current value set during the first period larger than the drive current value supplied to the display element during the second period.

If gradation rendering is to be controlled by a current supply amount to a light emission element, it is essential to reduce the current supply amount particularly for low gradation. In such a case, because of small current, it is feared that a current setting period or first period prolongs.

However, by using the invention regarding this embodiment type, write current during the first period can be made larger than the drive current during light emission period so that it is possible to suppress the current setting period from being prolonged.

If an OLED element is used as the display element, it can be considered that a supply current to the OLED element lowers because the current-luminance characteristics of the element are expected to be improved in the future. Also from this viewpoint, the present invention is effective which positively utilizes the hysteresis characteristics of a transistor.

It is also a preferable case that the gate voltage value determined during the first period is set equal to the gate voltage value while the drive current is supplied to the display element.

FIG. 3 shows the clockwise hysteresis characteristics in which the transistor changes from the off state to the on state and again to the off state. Not only the clockwise transistor, but also counter-clockwise transistor can be used for the invention.

Furthermore, it is also possible to configure that the drain current value set during the first period is set smaller than the drive current value supplied to the display element during the second period. This means that the drive current for light emission can be made large while the current value required for setting during the first period is maintained small.

In the following, description will be made illustratively on the circuit operations using a transistor having the clockwise hysteresis characteristics and a transistor having the counter-clockwise hysteresis characteristics.

1) In the Case of Clockwise Hysteresis

A transistor has the clockwise hysteresis and has different drain current values at the same gate voltage value between the case changing from the off state to the on state and the case changing from the on state to the off state. The first drain current is larger than the second one.

During the first period, the gate voltage value of the transistor in the off state is increased to flow a first current value (drain current).

Next, the gate voltage value of the transistor is increased further to enter the on state once. Thereafter, the gate voltage value is decreased or another operation is performed to supply a second current value smaller than the first current value to the display element as a drive current during the second period.

2) In the Case of Counter-Clockwise Hysteresis

A transistor has the counter-clockwise hysteresis and has different drain current values at the same gate voltage value between the case changing from the on state to the off state and the case changing from the off state to the on state. The first drain current is larger than the second one.

It is set within the first period in such a manner that a third current value flows through the transistor in the on state (for example, the third current value is set while the gate voltage is decreased).

Next, during the second period, the transistor is turned off once and then the gate voltage is increased or another operation is performed to supply a fourth current value smaller than the third current value to the display element as a drive current.

Description will be made illustratively on a manufacture method for a transistor having the hysteresis characteristics.

a) Example of Structure of Transistor Having Clockwise Hysteresis

After a photoresist film is formed on a glass substrate, a gate electrode pattern is formed by a photolithography method. Thereafter, Ti and Au in this order from the bottom are stacked by electron beam deposition, and a gate electrode is formed by a lift-off method.

Next, after a photoresist film is formed, an insulating layer pattern is formed by a photolithography method. Thereafter, an $SiO_2$ film is formed by a sputtering method, and an insulating layer is formed by a lift-off method.

Next, after a photoresist film is formed, an active layer pattern is formed by a photolithography method. Thereafter, a metal oxide semiconductor film of In—Ga—Zn—O is formed by a sputtering method, and an active layer is formed by a lift-off method.

Next, after a photoresist film is formed, a source/drain electrode pattern is formed by a photolithography method. Thereafter, Ti and Au in this order from the bottom are stacked by electron beam deposition, and source/drain electrodes are formed by a lift-off method.

By using the manufacture method described above, a bottom gate (inverse stagger) type thin film transistor (TFT) can be manufactured using $SiO_2$ for the gate insulating film.

A transistor having the clockwise hysteresis characteristics is likely to be formed in this manner although actually depending upon a thickness and film forming conditions of the active layer.

b) Example of Structure of Transistor Having Counter-Clockwise Hysteresis

After a photoresist film is formed on a glass substrate, a source/drain electrode pattern is formed by a photolithography method. Thereafter, Ti, Au and Ti in this order from the bottom are stacked by electron beam deposition, and source/drain electrodes are formed by a lift-off method.

Next, after a photoresist film is formed, an active layer pattern is formed by a photolithography method. Thereafter, a metal oxide semiconductor film of In—Ga—Zn—O is formed by a sputtering method, and an active layer is formed by a lift-off method.

Next, after a photoresist film is formed, an insulating layer pattern is formed by a photolithography method. Thereafter, a $Y_2O_3$ film is formed by a sputtering method, and an insulating film is formed by a lift-off method.

Next, after a photoresist film is formed, a gate electrode pattern is formed by a photolithography method. Thereafter, Ti and Au in this order from the bottom are stacked by electron beam deposition, and a gate electrode is formed by a lift-off method.

By using the manufacture method described above, a top gate type thin film transistor (TFT) can be manufactured using $Y_2O_3$ for the gate insulating film. A transistor having the counter-clockwise hysteresis characteristics is likely to be formed in this manner although actually depending upon a thickness and film forming conditions of the active layer.

Description will be made on the hysteresis characteristics of a transistor applied to the invention regarding this embodiment type.

Transistors operating as switches are usually provided in the pixel circuit. If the voltage value in the on state of the transistor for supplying a drive current to the display element is higher than the maximum gate voltage VDD of the transistor operating as the switch, the circuit does not operate normally.

Similarly, if the voltage value in the off state of the transistor for supplying a drive current is lower than the minimum gate voltage VSS of the transistor operating as the switch, the circuit does not operate normally.

Therefore, it is preferable that the voltage values in the on state and in the off state are (VDD−5V) or smaller and (VSS+5V) or higher, respectively.

Although the values of VDD and VSS depend upon design factors determined by a current performance of TFT, VDD is higher than 10 V and VSS is lower than −5 V in many cases.

Therefore, the present invention can be utilized if a transistor have the hysteresis characteristics in which the gate voltage value set during the first period is in the range of (VDD−5 V)−(VSS+5 V)=5 V.

However, this range can be widened by changing the voltages VDD and VSS, and the above-described range is only an example.

Second Embodiment Type

Pixel Circuit Positively Utilizing Only one of First and Second Relations of Hysteresis Next, description will be made on the invention regarding the second embodiment type.

First, similar to the invention regarding the first embodiment type, a transistor is prepared which has a first relation between a gate voltage value and a drain current value while an off state is changed to an on state and a second relation different from the first relation, between a gate voltage value and a drain current value while an on state is changed to an off state.

Similar to those elements described in the first embodiment type, there are provided a display element whose switching operation of supply current being conducted by the transistor, and a capacitor element connected to the gate electrode of the transistor.

The pixel circuit regarding this embodiment type operates in the state having a first period during which a drive current to be supplied to the display element is set and a second period during which light emission is effected by supplying the drive current to the display element.

(1) After the transistor is set in the off state, the gate voltage value is increased or another operation is performed to set the drive current (first period), thereafter, after the transistor is set in the off state once, the gate voltage value is increased or another operation is performed to supply the drive current to the display element (second period), or (2) after the transistor is set in the on state, the drive current is set (first period) and thereafter the transistor is set in the on state once to supply the drive current to the display element (second period).

In some cases, the drive current based on the only one of the said two relations can be supplied to the display element without going through a predetermined state (off state in (1) and on state in (2)) during the first period for setting the drive current. Then, it is necessary to set the current without flowing the current between the source and the drain of the transistor. For example, it is able that voltage is applied to the transistor's gate that does not connect with a source or drain of the transistor. After that, the predetermined state enters, and after the set state during the first period may resume to supply the drive current to the display element. This result shows that the drive current based on the only one of the said two relations can be supplied to the display element without going through a predetermined state. When the current is supplied to the display element after the predetermined state, the original state, which is the gate voltage value set during the first period in this case, is not necessarily resumed.

For example, the drain current value for setting the drive current during the first period may be set larger than the drive current to supply and drive the display element during the second period, or vice versa, or both the values may be the same.

By structuring and operating the pixel circuit in this manner, during both the first and second periods, the transistor which supplies the drive current to the display element can act based on only one of the first and second relations.

Third Embodiment Type

Image Display Apparatus

The image display device of this embodiment type includes a pixel circuit 2799 described in the inventions regarding the first and second embodiment types to constitute one pixel.

As shown in FIG. 27, a plurality of pixels are arranged in a matrix shape.

The image display apparatus is realized by connecting data lines 2701 and scan lines 2702 to the pixel circuit 2799 (for reference numbers, refer to FIG. 26).

Description will now be made on the invention regarding this embodiment type by explaining specific circuit structures and operations.

The first to third embodiments, the fifth to seventh embodiments, and the ninth and tenth embodiments show examples of the structure using both the first and second relations of the hysteresis characteristics (i.e., corresponding to the first embodiment type).

The fourth and eighth embodiments show examples of the structure using only one of the first and second relations of the hysteresis characteristics (i.e., corresponding to the second embodiment type).

In the following embodiments, although description will be made by using exemplary a driving method for an OLED element, the present invention is not limited to the OLED element, but the present invention is applicable to driving other display elements.

First Embodiment

FIG. 1 shows an example of the structure of a pixel circuit 1000.

This embodiment has an OLED element LED1 (1002) whose one end is connected to a second line L2 (1005).

The OLED element LED1 (1002) is one example of a display element. The embodiment has also a drive circuit for driving the OLED element LED1. The drive circuit is constituted as in the following.

There is provided an n-type first transistor Tr1 (1001) whose source is connected to a first line L1 (1006) and whose gate is connected to one end of a capacitor element C1 (1003).

One end of the capacitor element C1 is connected to the gate of the n-type transistor Tr1 (1001), and the other end thereof is connected to a fourth line L4 (1007). There is provided a first switch SW1 (1011) whose one end is connected to the drain of the n-type transistor Tr1 and whose other end is connected to a third line L3 (1008).

There is also provided a second switch SW2 (1012) whose one end is connected to the gate of the transistor Tr1 and whose other end is connected to the drain of the transistor Tr1. There are also provided a third switch SW3 (1013) whose one end is connected to the drain of the transistor Tr1 and whose other end is connected to the OLED element LED1 and a fourth switch SW4 (1014) whose one end is connected to the drain of the transistor Tr1 and whose other end is connected to the line L4.

FIG. 2 shows the timing chart illustrating the operation of the pixel circuit.

Constant voltages VSS1 and VDD1 are applied to the lines L1 and L2 (1006, 1005), respectively, and a proper current Id1 is supplied to the line L3. A gate voltage of the transistor Tr1 is represented by Vg. It is assumed that the transistor Tr1 has the clockwise hysteresis characteristics shown in FIG. 3.

First, as shown in FIG. 2, the switches SW1 and SW2 are turned on and the switches SW3 and SW4 are turned off, during a current setting period (first period). This state is shown in FIG. 4. A voltage level of the line L4 is assumed to be an L level.

In this case, a current Id1 is supplied to the transistor Tr1 from the line L3, and the gate voltage Vg of the transistor Tr1 is a voltage at which the current Id1 flows in a stable state. Thereafter, at the end of the current setting period, the switches SW1 and SW2 are turned off so that the voltage making the current Id1 flow is retained at the gate of the transistor Tr1 and in the capacitor C1.

Next, as shown in FIG. 2, the switch SW4 is turned on and the switches SW1 to SW3 are turned off. This state is shown in FIG. 5. A voltage level at the line L4 is assumed to be an H level. In this case, the gate voltage Vg of the transistor Tr1 rises because of a charge pumping effect. Since the drain is connected to the line L4, a large current flows through the transistor Tr1 so that the transistor Tr1 turns on. Thereafter, the voltage level at the line L4 is set to L and the switch SW4 is turned off so that the gate voltage Vg resumes the original voltage.

Next, as shown in FIG. 2, the switch SW3 is turned on during a light emission period (second period). This state is shown in FIG. 6. In this case, a current corresponding to the voltage set during the current setting period flows through the OLED element LED1 and through the source-drain of the transistor Tr1, as a current Id2 so that the OLED element LED1 emits light.

Next, as shown in FIG. 2, the switches SW2 and SW4 are turned on. This state is shown in FIG. 7. In this case, the drain and gate of the transistor Tr1 are shorted so that the L level is applied from the line L4 and the transistor Tr1 turns off.

In this embodiment, the current setting period, period of increasing the voltage, light emission period and period of decreasing the voltage are repetitively operated. In this case, the transistor Tr1 turns off before the current setting period, and turns on before the light emission period. Therefore, because of the hysteresis characteristics of the transistor Tr1 shown in FIG. 3, the current Id1 during the current setting period can be set larger than the current Id2 during the light emission period. The current setting period can thus be shortened.

Further, since the voltage is set by the current flowing during the current setting period, a current without variation can be supplied to the OLED element LED1 even if the threshold value of the transistor Tr1 has variation, if the hysteresis characteristics have no variation.

Second Embodiment

FIG. 8 shows an example of the structure of a pixel circuit.

In this embodiment, there are provided an OLED element LED1 whose one end is connected to a second line L2 and a drive circuit for the OLED element LED1. The drive circuit is constituted as in the following.

There are provided an n-type first transistor Tr1 whose source is connected to the first line L1 and a capacitor C1 whose one end is connected to a gate of the transistor Tr1 and whose other end is connected to a fourth wiring L4. There are also provided a first switch SW1 whose one end is connected to the drain of the transistor Tr1 and whose other end is connected to a third line L3, and a second switch SW2 whose one end is connected to the gate of the transistor and whose other end is connected to the drain.

There are further provided a third switch SW3 whose one end is connected to the drain of the transistor Tr1 and whose other end is connected to the OLED element LED1, and a fourth switch SW4 whose one end is connected to the drain of the transistor Tr1 and whose other end is connected to a fourth line L4.

There is also provided a fifth switch SW5 whose one end is connected to the line L4 and whose other end is connected to one end of the capacitor C1 on the side not connected to the gate of the transistor Tr1. There is also provided a sixth switch SW6 whose one end is connected to the line L1 and whose other end is connected to one end of the capacitor C1 on the side not connected to the gate of the transistor Tr1. The transistor Tr1 is assumed to have the clockwise hysteresis characteristics shown in FIG. 3.

FIG. 9 shows the timing chart of this embodiment type. The operations of the switches SW1 to SW4 are similar to those shown in FIG. 2. Similar to FIG. 2, constant voltages VSS1 and VDD1 are applied to the lines L1 and L2, respectively, and a proper current Id1 is applied to the line L3. A gate voltage of the transistor Tr1 is represented by Vg.

In this embodiment, the switches SW5 and SW6 are added to the structure of the first embodiment.

As shown in FIG. 9, the switch SW5 is turned off and the switch SW6 is turned on during the current setting period and during the light emission period.

In this case, one end of the capacitor C1 can be connected to the gate of the transistor Tr1 and the other end can be connected to the source of the transistor Tr1, during the current setting period and during the light emission period. Therefore, even if the line L1 has a non-preferable voltage variation, the gate-source voltage of the transistor Tr1 can be fixed because of the charge pumping function of the capacitor C1.

Therefore, not only the same advantages as those of the first embodiment can be obtained, but also it is possible to avoid a lower precision of current flowing through the OLED element LED1 and through the drain-source of the transistor Tr1 during the light emission period.

Third Embodiment

FIG. 10 shows an example of the structure of a pixel circuit. This embodiment has an OLED element LED1 whose one end is connected to a second line L2 and a drive circuit for the OLED element LED1. The drive circuit is constituted as in the following.

There is provided an n-type first transistor Tr1 whose source is connected to a first line L1 and whose gate is connected to one end of a capacitor C1. One end of the capacitor C1 is connected to the gate of the transistor Tr1. There is also provided a first switch SW1 whose one end is connected to the drain of the transistor Tr1 and whose other end is connected to a third line L3.

There is also provided a second switch SW2 whose one end is connected to the gate of the transistor Tr1 and whose other end is connected to the drain of the transistor Tr1. There is also provided a third switch SW3 whose one end is connected to the drain of the transistor Tr1 and whose other end is connected to one end of the OLED element LED 1 on the side not connected to the line L2. The transistor Tr1 is assumed to have the clockwise hysteresis characteristics shown in FIG. 3.

FIG. 11 shows the timing chart of this embodiment. A voltage at the line L1 is not fixed to VSS1, but changes. The other lines L2, L3 and L4 are similar to those shown in FIG. 2. The operations of the switches SW1 to SW3 are similar to those shown in FIG. 2.

In this embodiment, the switch SW4 of the first embodiment shown in FIG. 1 is removed, and as shown in FIG. 11, the voltage at the line L1 is lowered during the period of increasing the voltage. Therefore, the gate-source voltage of the transistor Tr1 increases during the period of increasing the voltage so that the transistor Tr1 can be turned on. Therefore, even if the number of components is small, the operations and advantages similar to those of the first embodiment can be realized.

Fourth Embodiment

Next, description will be made on an example of the structure of a pixel circuit according to the fourth embodiment.

Although the structure of the circuit is the same as that of the first embodiment, the operation is different.

Voltages at respective lines are similar to those of the first embodiment, excepting the voltage at the line L4.

In this embodiment, as will be later described, a current during the current setting period is set equal to a current during a light emission period.

This is also applied to the eighth embodiment to be described later.

FIG. 12 is the timing chart of this embodiment.

In this embodiment, as shown in FIG. 12, during the period corresponding to the period of increasing the voltage in the first embodiment, a voltage at the line L4 is lowered to form a period 1 of decreasing the voltage, and the period corresponding to the period of decreasing the voltage of the first embodiment is used as a period 2 of decreasing the voltage.

As a voltage at the line L4 is lowered during the period 1 of decreasing the voltage, a voltage at the gate of the transistor Tr1 takes a voltage turning off the transistor Tr1, because of the charge pumping effect.

Therefore, since the transistor Tr1 turns off before the current setting period and before the light emission period, a current supplied to the drive circuit during the current setting period is the same as a current supplied to the OLED element LED1 by the drive circuit during the light emission period, even if the transistor Tr1 has the hysteresis characteristics. In this case, the hysteresis characteristics are the clockwise hysteresis characteristics shown in FIG. 3. The counter-clockwise hysteresis characteristics may also be used.

Further, since the voltage conditions before the light emission period and current setting period are fixed, it is possible to suppress voltage variation to be caused by hysteresis. Therefore, in this embodiment type, a current without variation can be supplied to LED1 irrespective of variation in the transistor characteristics, if there is no influence of the hysteresis characteristics and there is no variation in the current supplied during the current setting period.

Similar advantages can be obtained by providing the period of increasing the voltage instead of the period of decreasing the voltage before the current setting period and light emission period. Namely, in this embodiment type. although the transistor Tr1 is turned off before the current setting period and light emission period, the transistor Tr1 may be turned on before the current setting period and light emission period.

Fifth Embodiment

The fifth to eighth embodiments provide pixel circuits improved from a pixel circuit shown in FIG. 29.

First, the pixel circuit shown in FIG. 29 will be described.

Two TFTs (Tr1 and Tr2) constitute a current mirror. The gate and drain of one TFT of the current mirror are shorted, and current is supplied from an external. A voltage of the gate of one TFT in the current mirror is set to flow an external current.

The other TFT of the current mirror supplies current to an OLED element LED1 in accordance with an applied voltage. Since two TFTs constituting the current mirror are disposed near each other, a variation of the characteristics of two TFTs is small, and a current supplied to the OLED element is determined by the current supplied from the external. The circuit structure will be described specifically.

There are provided the OLED element LED1 whose one end is connected to a second line L2, and a drive circuit for the OLED element. The drive circuit is provided with an n-type first transistor Tr1 whose source is connected to a first line L1, whose gate is connected to one end of a capacitor C1 and whose drain is connected to one end of the OLED element LED1 on the side not connected to the line L2.

There is also provided an n-type second transistor Tr2 whose source is connected to the first line L1 and whose gate is connected to one end of the capacitor C1. The other end of the capacitor C1 is connected to the sources of the first and second transistors Tr1 and Tr2.

There is further provided a first switch SW1 whose one end is connected to the drain of the transistor Tr2 and whose other end is connected to a third line L3. There is also provided a second switch SW2 whose one end is connected to the gates of the transistors Tr1 and Tr2 and whose other end is connected to the drain of the transistor Tr2. It is assumed herein that at least the transistor Tr1 has the clockwise hysteresis characteristics shown in FIG. 3.

In this example, the switches SW1 and SW2 are turned on during the current setting period to supply current to the transistor Tr2 from the line L3. In a stable state, a voltage is applied to the gate of the transistor Tr2 to flow the corresponding current. Thereafter, the switches SW1 and SW2 are turned off so that the voltage at the gate of the transistor Tr2 is retained in the capacitor C1. In accordance with the retained voltage, the transistor Tr1 flows current through the OLED element LED1.

FIG. 13 shows an example of the structure of a pixel circuit according to the fifth embodiment.

The pixel circuit shown in FIG. 13 is an improved circuit of the pixel circuit shown in FIG. 29. In this embodiment, there are provided an OLED element LED1 whose one end is connected to a second line L2, and a drive circuit for the OLED element.

The drive circuit is provided with an n-type first transistor Tr1 whose source is connected to a first line L1 and whose gate is connected to one end of a capacitor C1. The drive circuit is also provided with an n-type second transistor Tr2 whose source is connected to the first line L1 and whose gate is connected to one end of the capacitor C1. The other end of the capacitor C1 is connected to a line L4, and the gates of the transistors Tr1 and Tr2 are connected together.

There is provided a first switch SW1 whose one end is connected to the drain of the transistor Tr2 and whose other end is connected to a third line L3. There is also provided a second switch SW2 whose one end is connected to the gates of the transistors Tr1 and Tr2 and whose other end is connected to the drain of the transistor Tr2.

There is also provided a third switch SW3 whose one end is connected to a line L4 and whose other end is connected to the drain of the transistor Tr1. There is also provided a fourth switch SW4 whose one end is connected to one end of the OLED element LED1 on the side not connected to the line L2 and whose other end is connected to the drain of the transistor Tr1. It is herein assumed that at least the transistor Tr1 has the clockwise hysteresis characteristics shown in FIG. 3.

FIG. 14 is the timing chart illustrating the operation of this embodiment. Constant voltages VSS1 and VDD1 are applied to the lines L1 and L2, respectively and a proper current Id1 is supplied to the line L3. A gate voltage of the transistor Tr1 is represented by Vg. For the purpose of simplicity, it is assumed that the electric characteristics of the transistors Tr1 and Tr2 are identical.

First, as shown in FIG. 14, the switches SW1, SW2 and SW4 are turned on and the switch SW3 is turned off, during the current setting period. A voltage level at the line L4 is L. In this case, the current Id1 from the line L3 is supplied to the transistor Tr2, and in a stable state the gate voltage Vg of the transistor Tr2 makes the current Id1 flow. Thereafter, at the end of the current setting period, the switches SW1 and SW2 are turned off so that a voltage making the current Id1 flow is retained at the gate of the transistor Tr1 and in the capacitor C1.

Next, as shown in FIG. 14, during the period of increasing the voltage, the switch SW3 is turned on and the switches SW1, SW2 and SW4 are turned off to set the voltage level at the line L4 to H. In this case, the gate voltage Vg of the transistor Tr1 increases because of the charge pumping effect, and since the drain is connected to the line L4, a large current flows through the transistor Tr1 to turn on the transistor Tr1. Thereafter, the voltage level at the line L4 is set to L and the switch SW3 is turned off so that the voltage Vg resumes an original voltage.

Next, as shown in FIG. 14, the switch SW4 is turned on and the switches SW1 to SW3 are turned off. In this case, a current corresponding to the voltage set during the current setting period flows through the OLED element LED1 and through the source-drain of the transistor Tr1, as a current Id2 so that the OLED element LED1 emits light.

Next, during the period of decreasing the voltage, the switches SW2 and SW3 are turned on and the switches SW1 and SW4 are turned off. In this case, the drain and gate of the transistor Tr2 are shorted so that the gate voltages of the transistors Tr1 and Tr2 turn off the transistors.

The current setting period, period of increasing the voltage, light emission period and period of decreasing the voltage are repetitively operated. The transistors Tr1 and Tr2 are turned off before the current setting period, and the transistor Tr1 is turned on before the light emission period. Therefore, because of the hysteresis characteristics of the transistor Tr1 shown in FIG. 3, the current Id1 during the current setting period can be set larger than the current Id2 during the light emission period. The current setting period can thus be shortened.

Further, since the voltage is set by the current flowing during the current setting period, there is no variation in the characteristics of the transistors Tr1 and Tr2 even if the absolute threshold values have a variation. A current without variation can be supplied to the OLED element LED1 if the hysteresis characteristics have no variation. Further, since the voltage conditions before the light emission period and current setting period are fixed, it is possible to suppress a current variation to be caused by the influence of hysteresis of the transistors.

Sixth Embodiment

FIG. 15 shows an example of the structure of a pixel circuit of this embodiment.

In this embodiment, there are provided an OLED element LED1 whose one end is connected to a second line L2 and a drive circuit for the OLED element. The drive circuit is constituted as in the following.

There is provided an n-type first transistor Tr1 whose source is connected to a first line L1 and whose gate is connected to one end of a capacitor C1. There is also provided an n-type second transistor Tr2 whose source is connected to the first line L1 and whose gate is connected to one end of the capacitor C1. There is provided a first switch SW1 whose one end is connected to the drain of the transistor Tr2 and whose other end is connected to a third line L3. There is also provided a second switch SW2 whose one end is connected to the gates of the transistors Tr1 and Tr2 and whose other end is connected to the drain of the transistor Tr2.

There is also provided a third switch SW3 whose one end is connected to a line L4 and whose other end is connected to the drain of the transistor Tr1. There is also provided a fourth switch SW4 whose one end is connected one end of the OLED element LED1 on the side not connected to the line L2 and whose other end is connected to the drain of the transistor Tr1.

There are also provided a fifth switch SW5 whose one end is connected to the line L4 and whose other end is connected to the capacitor C1 and a sixth switch SW6 whose one end is connected to the line L1 and whose other end is connected to one end of the capacitor C1. It is herein assumed that at least the transistor Tr1 has the clockwise hysteresis characteristics shown in FIG. 3.

FIG. 16 is the timing chart illustrating the operation of this embodiment. In this embodiment, the switches SW5 and SW6 are added to the structure shown in FIG. 13. The operations of the switches SW1 to SW4 and the voltage conditions of the lines L1 to L4 are similar to those shown in FIG. 14. For the purpose of simplicity, it is assumed that the electric characteristics of the transistors Tr1 and Tr2 are identical.

In this embodiment, as shown in FIG. 16, the switch SW5 is turned off and the switch 6 is turned on during the current setting period and light emission period. In this case, during the current setting period and light emission period, it is possible to connect one end of the capacitor C1 to the gate of the transistor Tr1 and connect the other end to the source of the transistor Tr1.

Therefore, even if there is a non-preferable voltage variation at the line L1, the gate-source voltage of the transistor Tr1 can be fixed by the charge pumping operation of the capacitor C1. It is therefore possible to avoid a lower precision of current flowing through the OLED element LED1 and through the drain-source of the transistor Tr1 during the light emission period.

Seventh Embodiment

FIG. 17 shows an example of the structure of a pixel circuit according to the seventh embodiment.

In this embodiment, there are provided an OLED element LED1 whose one end is connected to a second line L2, and a drive circuit for the OLED element. The drive circuit is constituted as in the following.

There is provided an n-type first transistor Tr1 whose source is connected to a first line L1, whose gate is connected to one end of a capacitor C1 and whose drain is connected to one end of an OLED element LED1 on the side not connected to the second line L2.

There is also provided an n-type second transistor Tr2 whose source is connected to the first line L1 and whose gate is connected to one end of the capacitor C1. The other end of the capacitor C1 is connected to a line L4, and the gates of the transistors Tr1 and Tr2 are connected together.

There is also provided a first switch SW1 whose one end is connected to the drain of the transistor Tr2 and whose other end is connected to a third line L3. There is also provided a second switch SW2 whose one end is connected to the gates of the transistors Tr1 and Tr2 and whose other end is connected to the drain of the transistor Tr2. It is herein assumed that at least the transistor Tr1 has the clockwise hysteresis characteristics shown in FIG. 3.

FIG. 18 is the timing chart of this embodiment. In this embodiment, a voltage at the line L1 is not fixed to VSS1, but is variable.

The conditions and the like of the other lines L2 to L4 are similar to those of FIG. 14. For the purpose of simplicity, in this embodiment it is assumed that the electric characteristics of the transistors Tr1 and Tr2 are identical.

In this embodiment, the switches SW3 and SW4 are removed from the structure of the fifth embodiment shown in FIG. 13, and as shown in FIG. 18, a voltage at the line L1 is lowered during the period of increasing the voltage. Therefore, the gate-source voltage of the transistor Tr1 becomes large and the transistor Tr1 can be turned on. Even if the number of elements is small, the operation and advantages similar to those of the fifth embodiment can be realized.

Eighth Embodiment

Although the structure of the pixel circuit of this embodiment has the same structure as that of the pixel circuit of the fifth embodiment described with reference to FIG. 13, the operation is partially different.

FIG. 19 is the timing chart of this embodiment type. The conditions of each line are similar to those of the fifth embodiment shown in FIG. 14, excepting the conditions of a line L4.

The operations of switches SW1 to SW4 are similar to those shown in FIG. 14. In this embodiment type, similar to the fourth embodiment, a current during the current setting period is the same as a current during the light emission period. For the purpose of simplicity, in this embodiment type, it is assumed that the electric characteristics of transistors Tr1 and Tr2 are identical.

In this embodiment, as shown in FIG. 19, a voltage at the line L4 is lowered during a period corresponding to the period of increasing the voltage in the fifth embodiment to form a period 1 of decreasing the voltage, and the period corresponding to the period of decreasing the voltage in the fifth embodiment is used as a period 2 of decreasing the voltage. As a voltage at the line L4 is lowered during the period 1 of decreasing the voltage, a gate voltage of the transistor Tr1 turns off the transistor Tr1 because of the charge pumping effect.

Therefore, since the transistor Tr1 turns off before the current setting period and before the light emission period, a current supplied to the drive circuit during the current setting period is the same as a current supplied to the OLED element LED1 by the drive circuit during the light emission period, even if the transistor Tr1 has the hysteresis characteristics. In this case, the hysteresis characteristics are the clockwise hysteresis characteristics shown in FIG. 3. The counter-clockwise hysteresis characteristics may also be used.

Further, since the voltage conditions before the light emission period and current setting period are fixed, it is possible to suppress voltage variation to be caused by the influence of hysteresis. Therefore, in this embodiment, a current without variation can be supplied to the OLED element LED1 irrespective of variation in the transistor characteristics during the light emission period, if there is no influence of the hysteresis characteristics and there is no variation in the current supplied during the current setting period.

Similar advantages can be obtained by providing the period of increasing the voltage instead of the period of decreasing the voltage before the current setting period and light emission period. Namely, in this embodiment, although the transistor Tr1 is turned off before the current setting period and light emission period, the transistor Tr1 may be turned on before the current setting period and light emission period.

As described above, although the fifth to eighth embodiments have the circuit structures different from those of the first to fourth embodiments, the fifth to eighth embodiments can provide the same functions as those of the first to fourth embodiments. This is true also for all light emission display devices having a drive circuit which sets the current supplied to the OLED element LED1 during the light emission period in accordance with the current supplied during the current setting period.

Namely, the operation of a transistor which determines the current to be supplied to the OLED element LED1 is fixed to ON or OFF before the current setting period or light emission period. Therefore, the advantages similar to those of the first to fourth embodiments can be obtained.

Further, this is also true for light emission display devices having a drive circuit of the type in which the current to be supplied to the OLED element LED1 during the light emission period is set by supplying a voltage during the current setting period.

Ninth Embodiment

Prior to describing the ninth embodiment, description will be made on the techniques upon which the ninth and tenth embodiments are based.

FIG. 20 shows a drive circuit.

In FIG. 20, there are provided an OLED element LED1 whose one end is connected to a second line L2 and a drive circuit for the OLED element. The drive circuit is constituted as in the following.

There is provided an n-type first transistor Tr1 whose source is connected to a first line L1 and whose gate is connected to one end of a capacitor C1. There is provided a first switch SW1 whose one end is connected to one end of the capacitor C1 on the side not connected to the gate of the transistor Tr1 and whose other end is connected to a third line L3.

There is also provided a second switch SW2 whose one end is connected to the gate of the transistor Tr1 and whose other end is connected to the drain of the transistor Tr1. There is also provided a third switch SW3 whose one end is connected to one end of the capacitor C1 on the side not connected to the gate of the transistor Tr1 and whose other end is connected to a fourth line L4.

There is also provided a fourth switch SW4 whose one end is connected to one end of the OLED element LED1 on the side not connected to the line L2 and whose other end is connected to the drain of the transistor Tr1. It is herein assumed that at least the transistor Tr1 has the clockwise hysteresis characteristics shown in FIG. 3.

FIG. 21 is the timing chart illustrating the operation of the pixel circuit having the structure shown in FIG. 20. Constant voltages VSS1, VDD1 and Vb are applied to the lines L1, L2 and L4, respectively, and a proper voltage Va is applied to the line L3. A voltage at the gate of the transistor Tr1 is represented by Vg, and a voltage at one end of the capacitor C1 on the side not connected to the gate of the transistor Tr1 is represented by V1.

In this example, as shown in FIG. 21, the switches SW1 and SW2 are turned on and the switch SW3 is turned off during the current setting period. The switch SW4 initially turned on is turned off at a point of time delayed from the point of time for turning on the switches SW1 and SW2. Namely, the switch SW4 turns off after current flows through the OLED element LED1 and through the drain-source of the transistor Tr1.

The voltage Vg takes a higher voltage than the threshold voltage Vth of the transistor Tr1 while the switch SW4 turns on, and thereafter takes the threshold voltage Vth when the switch SW4 turns off. The voltage V1 takes the voltage Va via the switch SW1 and line L3.

During the next light emission period, the switches SW1 and SW2 are turned off and the switches SW3 and SW4 are turned on. In this case, the voltage Vg takes a value Vb−Va+Vth because of the charge pumping effect. Therefore, the current flowing through the transistor Tr1 is proportional to $(Vg-Vth)^2$, i.e., $(Vb-Va)^2$ according to the drain current equation in the transistor saturation region, and does not depend upon the threshold voltage.

In the ninth embodiment, the structure described above is improved to the structure shown in FIG. 22.

The structure shown in FIG. 22 is different from that shown in FIG. 20 in that a fifth switch SW5 is connected between the line L4 and the drain of the transistor Tr1.

In this embodiment, there are provided an OLED element LED1 whose one end is connected to a second line, and a drive circuit for the OLED element. The drive circuit is constituted as in the following.

There is provided an n-type first transistor Tr1 whose source is connected to a first line L1 and whose gate is connected to one end of a capacitor C1. There is provided a first switch SW1 whose one end is connected to one end of the capacitor C1 on the side not connected to the gate of the transistor Tr1 and whose other end is connected to a third line L3.

There is also provided a second switch SW2 whose one end is connected to the gate of the transistor Tr1 and whose other end is connected to the drain of the transistor Tr1. There is also provided a third switch SW3 whose one end is connected to one end of the capacitor C1 on the side not connected to the gate of the transistor Tr1 and whose other end is connected to a fourth line L4.

There is also provided a fourth switch SW4 whose one end is connected to one end of the OLED element LED1 on the side not connected to the line L2 and whose other end is connected to the drain of the transistor Tr1. There is also provided a fifth switch SW5 whose one end is connected to the line L4 and whose other end is connected to the drain of the transistor Tr1. It is herein assumed that at least the transistor Tr1 has the clockwise hysteresis characteristics shown in FIG. 3.

FIG. 23 is the timing chart of this embodiment. Constant voltages VSS1 and VDD1 are applied to the lines L1 and L2, respectively. A proper voltage Va is applied to the line L3. The voltage Va is preferably higher than the threshold voltage of the transistor Tr1. A voltage at the gate of the transistor Tr1 is represented by Vg, and a voltage at one end of the capacitor C1 on the side not connected to the gate of the transistor Tr1 is represented by V1.

First, as shown in FIG. 23, the switches SW1 and SW2 are turned on and the switch SW3, SW4 and SW5 are turned off during the current setting period. In this case, the voltage V1 takes the voltage Va applied from the line L3 via the switch SW1. Although the voltage Vg rises because of the charge pumping effect, this voltage becomes stable at the threshold voltage Vth because the switch SW4 is turned off and the gate and drain of the transistor Tr1 are shorted.

Next, as shown in FIG. 23, the switches SW1, SW2 and SW4 are turned off and the switches SW3 and SW5 are turned on during the period of increasing the voltage. A voltage at the line L4 is raised properly. In this case, the voltage Vg becomes higher by the charge pumping effect so that the transistor Tr1 is turned on reliably.

During the next light emission period, the switches SW1, SW2 and SW5 are turned off and the switches SW3 and SW4 are turned on. A voltage at the line L4 is set to the voltage Vb. In this case, the voltage Vg is raised to Vb−Va+Vth by the charge pumping effect. Therefore, the current flowing through the transistor Tr1 is proportional to (Vg−Vth) 2, i.e., $(Vb-Va)^2$ according to the drain current equation in the transistor saturation region, and does not depend upon the threshold voltage.

Next, during the next period of decreasing the voltage, the switches SW1 and SW4 are turned off and the switches SW2, SW3 and SW5 are turned on. A voltage at the line L4 is set to VSS1. In this case, the gate, source and drain of the transistor Tr1 are all at VSS1 and the transistor is fixed to OFF. Both ends of the capacitor C1 take the same voltage.

The above operations are repetitively executed. In this case, the operation similar to that shown in FIG. 20 is possible, and since the voltage conditions before the light emission period and current setting period are fixed, it is possible to suppress current variation to be caused by the influence of hysteresis.

Similar advantages can be obtained by the structure of this embodiment, by setting the period of increasing the voltage to the period 1 of decreasing the voltage and setting the period of decreasing the voltage to the period 2 of decreasing the voltage. The timing chart of this case is shown in FIG. 24. The same advantages can be obtained by setting the period 1 of decreasing the voltage to the period 1 of increasing the voltage and by setting the period 2 of decreasing the voltage to the period 2 of increasing the voltage. Namely, these advantages are the same as the advantages of the fourth embodiment obtained by the drive circuit in which the current to be supplied to the OLED element LED1 during the light emission period is determined by using the current supplied during the current setting period. In case of setting the current by applying the voltage, a period of boosting voltage of a period of decreasing the voltage would not be necessary before the period of setting the current Tenth Embodiment Next, description will be made on an example of the structure of a pixel circuit according to the tenth embodiment. Although the structure of the embodiment is the same as that shown in FIG. 20, the operation is different. In this embodiment, the voltage VSS1 at the line L1 is not fixed, but is variable. FIG. 25 is the timing chart of this embodiment.

In this embodiment, as shown in FIG. 25, a voltage at the line L1 is lowered during the period of increasing the voltage. Therefore, the gate-source voltage of the transistor Tr1 becomes high and the transistor Tr1 can be turned on. Even if the number of elements is small, the operation and advantages similar to those of the first embodiment can be realized.

In fact, in the case of setting the current by applied a voltage like the ninth embodiment, the period of the increasing or decreasing voltage before the current setting period hardly has advantages, since this current setting is independent upon the current-voltage relation.

The structure that a voltage is applied to the gate of the transistor to turn on (off) the transistor before the current setting period and before the light emission period can be applied not only to the drive circuit of this embodiment, but also to the drive circuit described in International Publication No. WO99/065011 and the like.

In the first to tenth embodiments, although the transistor has the clockwise hysteresis (FIG. 3), similar operations are possible also for the counter-clockwise hysteresis.

In this case, the voltage increasing operation during the period of increasing the voltage or the voltage decreasing operation during the period 1 of decreasing the voltage to be executed before the light emission period is changed to the voltage decreasing operation during the period of decreasing the voltage or the voltage increasing operation during the period 1 of increasing the voltage. In addition, the voltage decreasing operation during the period of decreasing the voltage or the voltage decreasing operation during the period 2 of decreasing the voltage to be executed before the current setting period is changed to the voltage increasing operation during the period of increasing the voltage or the voltage increasing operation during the period 2 of increasing the voltage.

Specifically, in the structures of the first to tenth embodiments (excepting the fourth and eighth embodiments), for the clockwise hysteresis, a voltage turning off the transistor is applied to the gate before the current setting period and a voltage turning on the transistor is applied to the gate before the light emission period.

For the counter-clockwise hysteresis, a voltage turning on the transistor is applied to the gate before the current setting period and a voltage turning off the transistor is applied to the gate before the light emission period. In this manner, similar advantages can be obtained.

Further, in the first to tenth embodiments, the n-type transistor may be changed to an opposite p-type transistor by changing the polarity of applied voltage, the connection of the OLED element and the like.

Furthermore, in the first to sixth embodiments, the switches may be changed to transistors. The transistor and switch may be constituted of only n-type transistors or p-type transistors.

In the first to tenth embodiments, all transistors including switches may be field effect transistors using silicon crystal in the channel region, or thin film transistors using amorphous silicon, polysilicon, organic semiconductor or oxide semiconductor in the channel region. Particularly, if the thin film transistors are used, it is possible to manufacture a large size matrix type light emission display device on a glass or plastic substrate.

It is further possible to manufacture a large size, high precision and inexpensive matrix type light emission display device, because amorphous oxide semiconductor has a high mobility and can realize high speed circuit operations.

An example of amorphous oxide semiconductor is transparent amorphous oxide material described in International Publication No. WO2005/088726. More specifically, this material may be amorphous oxide material which contains In, Ga and Zn, oxide material which contains In and Ga, amorphous oxide material which contains In and Zn, amorphous oxide material which contains In and Sn, and the like. An electron carrier concentration is preferably less than $10^{18}$ $cm^{-3}$, and more preferably $10^{17}$ $cm^{-3}$ or less.

The present invention allows to configure an image display apparatus by arranging display elements, e.g., OLED elements LED1 and the drive circuits of each of the first to tenth embodiments, in a matrix shape on a substrate.

The concept of a repair circuit can be introduced into the case in which the TFT active layer uses transparent amorphous oxide described in International Publication No. WO2005/088726. For example, a plurality of TFTs are prepared in one pixel as drive TFTs for a display element such as OLED. If a defective pixel exists, a spare TFT is used by utilizing excimer laser.

More specifically, two pair of TFTs are prepared for a switching transistor for each pixel, and two pairs of TFTs are prepared for driving an OLED (diode). If a defective pixel does not exist, one of the two pairs is dummy TFTs. Even if a plurality of repair TFTs are prepared, this does not adversely affect considerably the aperture ratio since transparent TFTs are used. Detailed description of a repair circuit is given in Japanese Patent Application Laid-Open No. 2000-22776.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-067527, filed Mar. 13, 2006, which is hereby incorporated by reference herein in its entirety.

What is claimed is:

1. An image display apparatus comprising a pixel circuit, the pixel circuit comprising:

a transistor having hysteresis characteristics in which a relation between a gate voltage value and a drain current value at a transition from an off state to an on state and a relation between the gate voltage value and the drain current value at a transition from the on state to the off state are different;

a display element supplied a drive current controlled by said transistor; and a capacitor element directly connected between a gate electrode of said transistor and a voltage line, wherein:

after a first period for setting a gate-source voltage of the transistor to set the drive current to be supplied for the display element to emit light, and before a second period for supplying the drive current for the display element to emit light, the gate-source voltage of the transistor is controlled to be lower than a threshold voltage of the transistor of the first period in a case where the transistor has counter-clockwise hysteresis characteristics, and to be higher than the gate-source voltage of the transistor of the first period in a case where the transistor has clockwise hysteresis characteristics, wherein, after the second period and before the first period of a subsequent frame the gate-source voltage of the transistor is controlled to be lower than the threshold voltage of the transistor in a case where the transistor has clockwise hysteresis characteristics, and the gate-source voltage of the transistor is controlled to be higher than the gate-source voltage of the transistor of the first period when the transistor has counter-clockwise hysteresis characteristics.

2. The image display apparatus according to claim 1, wherein the gate-source voltage after the first period and before the second period is controlled by a change in voltage level of a wiring connected to the gate of the transistor via the capacitor.

3. The image display apparatus according to claim 1, wherein said display element in said pixel circuit is an OLED element.

4. The image display apparatus according to claim 1, wherein a channel layer of said transistor constituting the pixel circuit is made of amorphous silicon, amorphous silicon oxide material, or organic semiconductor material.

* * * * *